US008942600B2

(12) United States Patent
Nakaue et al.

(10) Patent No.: US 8,942,600 B2
(45) Date of Patent: Jan. 27, 2015

(54) DEVELOPING APPARATUS AND IMAGE FORMING APPARATUS

(71) Applicant: KYOCERA Document Solutions Inc., Osaka-shi, Osaka (JP)

(72) Inventors: Takahisa Nakaue, Osaka (JP); Tamotsu Shimizu, Osaka (JP); Ikuo Makie, Osaka (JP); Kenichi Tamaki, Osaka (JP); Minoru Wada, Osaka (JP); Takefumi Yotsutsuji, Osaka (JP); Shizuka Okada, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/082,037

(22) Filed: Nov. 15, 2013

(65) Prior Publication Data

US 2014/0140732 A1 May 22, 2014

(30) Foreign Application Priority Data

Nov. 22, 2012 (JP) ..... 2012-256073
Nov. 22, 2012 (JP) ..... 2012-256074

(51) Int. Cl.
*G03G 15/08* (2006.01)

(52) U.S. Cl.
CPC ..... *G03G 15/0865* (2013.01); *G03G 15/0893* (2013.01)
USPC ..... 399/254

(58) Field of Classification Search
USPC ..... 399/254
See application file for complete search history.

(56) References Cited

U.S. PATENT DOCUMENTS

| | | | | |
|---|---|---|---|---|
| 6,421,516 | B1 | 7/2002 | Kinoshita et al. | |
| 6,987,940 | B2 * | 1/2006 | Tamura | 399/227 |
| 7,702,262 | B2 * | 4/2010 | Taguchi et al. | 399/262 |
| 7,720,417 | B2 * | 5/2010 | Taguchi et al. | 399/258 |
| 7,822,371 | B2 * | 10/2010 | Taguchi et al. | 399/262 |
| 7,826,777 | B2 * | 11/2010 | Taguchi et al. | 399/258 |
| 7,835,675 | B2 * | 11/2010 | Taguchi et al. | 399/262 |
| 8,073,367 | B2 * | 12/2011 | Hayashi | 399/263 |
| 8,126,375 | B2 * | 2/2012 | Taguchi et al. | 399/258 |

(Continued)

FOREIGN PATENT DOCUMENTS

| | | | |
|---|---|---|---|
| JP | 2001092253 | A | 4/2001 |
| JP | 2005346116 | A | 12/2005 |

(Continued)

*Primary Examiner* — Rodney Fuller
(74) *Attorney, Agent, or Firm* — Alleman Hall McCoy Russell & Tuttle LLP

(57) ABSTRACT

A developing apparatus according to one aspect of the present disclosure includes a developing roller, a development housing, a first agitating screw, a toner supply inlet, a downstream-side reduction wall, and an upstream-side reduction wall. The developing roller is driven to rotate in the development housing, and carries toner on the circumferential surface thereof. Toner is circulated and conveyed in a first conveying path and a second conveying path in the development housing. The first agitating screw is disposed in the first conveying path, and conveys toner in a first direction. The downstream-side reduction wall is disposed downstream of the toner supply inlet. Further, the upstream-side reduction wall is disposed upstream of the toner supply inlet. An accumulation portion for toner is formed downstream and upstream of the toner supply inlet due to the downstream-side reduction wall and the upstream-side reduction wall.

18 Claims, 21 Drawing Sheets

(56) References Cited

U.S. PATENT DOCUMENTS

| | | | |
|---|---|---|---|
| 2007/0122203 | A1 | 5/2007 | Sugimoto et al. |
| 2007/0242981 | A1 | 10/2007 | Hirota |
| 2008/0145105 | A1 | 6/2008 | Iwamura |

FOREIGN PATENT DOCUMENTS

| | | | |
|---|---|---|---|
| JP | 2007148014 | A | 6/2007 |
| JP | 2007286290 | A | 11/2007 |
| JP | 2008151997 | A | 7/2008 |

* cited by examiner

DEVELOPING APPARATUS AND IMAGE FORMING APPARATUS

INCORPORATION BY REFERENCE

This application is based upon and claims the benefit of priority from the corresponding Japanese Patent Application No. 2012-256073 filed on Nov. 22, 2012, and No. 2012-256074 filed on Nov. 22, 2012, the entire contents of which are incorporated herein by reference.

BACKGROUND

The present disclosure relates to developing apparatuses that are suitably used for image forming apparatuses such as copy machines and printers, and image forming apparatuses having the developing apparatuses mounted therein.

To date, developing devices for use in image forming apparatuses have been known. The developing device includes: a development housing having a developing roller and an agitating screw; and a toner container that is detachably mounted to the development housing for supplying toner. A toner outlet is formed in a bottom portion of the toner container so as to be openable and closable, and a toner supply inlet is formed in the development housing at a position corresponding to the toner outlet. When the toner container is mounted to the development housing, and the toner outlet and the toner supply inlet are opened, toner in the toner container is supplied into a predetermined circulation-conveying path formed in the development housing.

The circulation-conveying path includes a forward conveying path for the toner supply inlet, and a return conveying path for the developing roller. In each conveying path in the circulation-conveying path, an agitating screw having helical blades provided around a rotation shaft is mounted. Toner is circulated and conveyed, by the agitating screws, in and between the forward conveying path and the return conveying path.

In the developing device having such a structure, a conveying capability reduction portion configured to locally reduce conveying capability is provided, downstream of the toner supply inlet, on the downstream side of the agitating screw disposed in the forward conveying path. Due to the conveying capability reduction portion, an accumulation portion for toner is formed, near the toner supply inlet, upstream of the conveying capability reduction portion. When an amount of toner is increased in the accumulation portion, the toner supply inlet is blocked with toner in the accumulation portion. On the other hand, when an amount of toner is reduced in the accumulation portion, a gap is generated between the toner supply inlet and the accumulation portion for toner, and toner enters the development housing from the toner container. Thus, an amount of toner to be additionally supplied from the toner container into the development housing is adjusted according to an amount of toner accumulated in the accumulation portion.

SUMMARY

A developing apparatus according to one aspect of the present disclosure includes a housing, an additional-developer storage portion, a developing roller, a developer conveying path, a divider, a first communication path, a second communication path, a developer reception opening, a conveying member, a downstream-side conveying capability reduction portion, and an upstream-side conveying capability reduction wall. The housing has a pair of wall portions, and a top cover that extends between the pair of wall portions. The additional-developer storage portion is detachably mounted to the housing and stores additional developer to be supplied into the housing. The developing roller is rotatably supported, by the housing, between the pair of wall portions, and carries developer. The developer conveying path includes a first conveying path which is disposed in the housing so as to be spaced from the developing roller, and in which the developer is conveyed in a first direction, and a second conveying path which is disposed between the developing roller and the first conveying path, in which the developer is conveyed in a second direction opposite to the first direction, and by which the developer is supplied to the developing roller, and the developer conveying path has an upper portion defined by the top cover. The divider is disposed in the housing and divides the first conveying path and the second conveying path from each other. The first communication path disposed between one of the paired wall portions and a corresponding one of end portions of the divider, and has a function of delivering the developer from the first conveying path to the second conveying path. The second communication path is disposed between the other of the paired wall portions and the other of the end portions of the divider, and has a function of delivering the developer from the second conveying path to the first conveying path. The developer reception opening is formed in the housing so as to oppose a position on a downstream side, in the first direction, of the first conveying path, and allows the additional developer to be received therethrough and supplied into the developer conveying path. The conveying member is disposed in the first conveying path, is driven to rotate, and conveys the developer in the first direction such that the developer passes by a position where the developer reception opening opposes the first conveying path. The downstream-side conveying capability reduction portion is disposed, in the conveying member or the housing, downstream of the developer reception opening in the first direction, and locally reduces a developer conveying capability, for the developer, of the conveying member, to form a first accumulation portion in which the developer is accumulated at a position opposing the developer reception opening. The upstream-side conveying capability reduction wall is disposed upstream of the developer reception opening in the first direction so as to project from the top cover toward the conveying member, and locally reduces a developer conveying capability, for the developer, of the conveying member, to form a second accumulation portion in which the developer is accumulated upstream of the developer reception opening in the first direction.

A developing apparatus according to another aspect of the present disclosure includes a housing, an additional-developer storage portion, a developing roller, a developer conveying path, a developer reception opening, a conveying member, and a conveying capability reduction wall. The housing has a pair of wall portions, and a top cover that extends between the pair of wall portions. The additional-developer storage portion is detachably mounted to the housing and stores additional developer to be supplied into the housing. The developing roller is rotatably supported, by the housing, between the pair of wall portions, and carries developer. The developer conveying path includes a first conveying path which is disposed in the housing so as to be spaced from the developing roller, and in which the developer is conveyed in a first direction, and a second conveying path which is disposed between the developing roller and the first conveying path, in which the developer is conveyed in a second direction opposite to the first direction, and by which the developer is supplied to the developing roller, and the developer conveying path has an upper portion defined by the top cover, and allows the developer to be circulated and conveyed therein. The developer reception opening is formed in the housing so as to oppose a position on a downstream side, in the first direction, of the first conveying path, and allows the additional developer to be received therethrough and supplied into the developer conveying path. The conveying member is disposed in the first conveying path, is driven to rotate, and conveys the developer in the first direction such that the developer passes by a position where the developer reception opening opposes the first conveying path. The conveying capability reduction wall is disposed downstream of the developer reception opening in the first direction so as to project from the top cover toward the conveying member, and locally reduces a developer conveying capability, for the developer, of the conveying member, to form an accumulation portion in which the developer is accumulated at a position opposing the developer reception opening.

An image forming apparatus according to still another aspect of the present disclosure includes a developing apparatus, an image carrier, and a transfer device. The image carrier has a surface on which an electrostatic latent image is formed, and to which developer is supplied from the developing apparatus. The transfer device transfers an image from the image carrier to a sheet. The developing apparatus includes a housing, an additional-developer storage portion, a developing roller, a developer conveying path, a divider, a first communication path, a second communication path, a developer reception opening, a conveying member, a downstream-side conveying capability reduction portion, and an upstream-side conveying capability reduction wall. The housing has a pair of wall portions, and a top cover that extends between the pair of wall portions. The additional-developer storage portion is detachably mounted to the housing and stores additional developer to be supplied into the housing. The developing roller is rotatably supported, by the housing, between the pair of wall portions, and carries developer. The developer conveying path includes a first conveying path which is disposed in the housing so as to be spaced from the developing roller, and in which the developer is conveyed in a first direction, and a second conveying path which is disposed between the developing roller and the first conveying path, in which the developer is conveyed in a second direction opposite to the first direction, and by which the developer is supplied to the developing roller, and the developer conveying path has an upper portion defined by the top cover. The divider is disposed in the housing and divides the first conveying path and the second conveying path from each other. The first communication path is disposed between one of the paired wall portions and a corresponding one of end portions of the divider and has a function of delivering the developer from the first conveying path to the second conveying path. The second communication path is disposed between the other of the paired wall portions and the other of the end portions of the divider, and has a function of delivering the developer from the second conveying path to the first conveying path. The developer reception opening is formed in the housing so as to oppose a position on a downstream side, in the first direction, of the first conveying path, and allows the additional developer to be received therethrough and supplied into the developer conveying path. The conveying member is disposed in the first conveying path, is driven to rotate, and conveys the developer in the first direction such that the developer passes by a position where the developer reception opening opposes the first conveying path. The downstream-side conveying capability reduction portion is disposed, in the conveying member or the housing, downstream of the developer reception opening in the first direction, and locally reduces a developer conveying capability, for the developer, of the conveying member, to form a first accumulation portion in which the developer is accumulated at a position opposing the developer reception opening. The upstream-side conveying capability reduction wall is disposed upstream of the developer reception opening in the first direction so as to project from the top cover toward the conveying member, and locally reduces a developer conveying capability, for the developer, of the conveying member, to form a second accumulation portion in which the developer is accumulated upstream of the developer reception opening in the first direction.

An image forming apparatus according to still another aspect of the present disclosure includes a developing apparatus, an image carrier, and a transfer device. The image carrier has a surface on which an electrostatic latent image is formed, and to which developer is supplied from the developing apparatus. The transfer device transfers an image from the image carrier to a sheet. The developing apparatus includes a housing, an additional-developer storage portion, a developing roller, a developer conveying path, a developer reception opening, a conveying member, and a conveying capability reduction wall. The housing has a pair of wall portions, and a top cover that extends between the pair of wall portions. The additional-developer storage portion is detachably mounted to the housing and stores additional developer to be supplied into the housing. The developing roller is rotatably supported, by the housing, between the pair of wall portions, and carries developer. The developer conveying path includes a first conveying path which is disposed in the housing so as to be spaced from the developing roller, and in which the developer is conveyed in a first direction, and a second conveying path which is disposed between the developing roller and the first conveying path, in which the developer is conveyed in a second direction opposite to the first direction, and by which the developer is supplied to the developing roller, and the developer conveying path has an upper portion defined by the top cover, and allows the developer to be circulated and conveyed therein. The developer reception opening is formed in the housing so as to oppose a position on a downstream side, in the first direction, of the first conveying path, and allows the additional developer to be received therethrough and supplied into the developer conveying path. The conveying member is disposed in the first conveying path, is driven to rotate, and conveys the developer in the first direction such that the developer passes by a position where the developer reception opening opposes the first conveying path. The conveying capability reduction wall is disposed downstream of the developer reception opening in the first direction so as to project from the top cover toward the conveying member, and locally reduces a developer conveying capability, for the developer, of the conveying member, to form an accumulation portion in which the developer is accumulated at a position opposing the developer reception opening.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
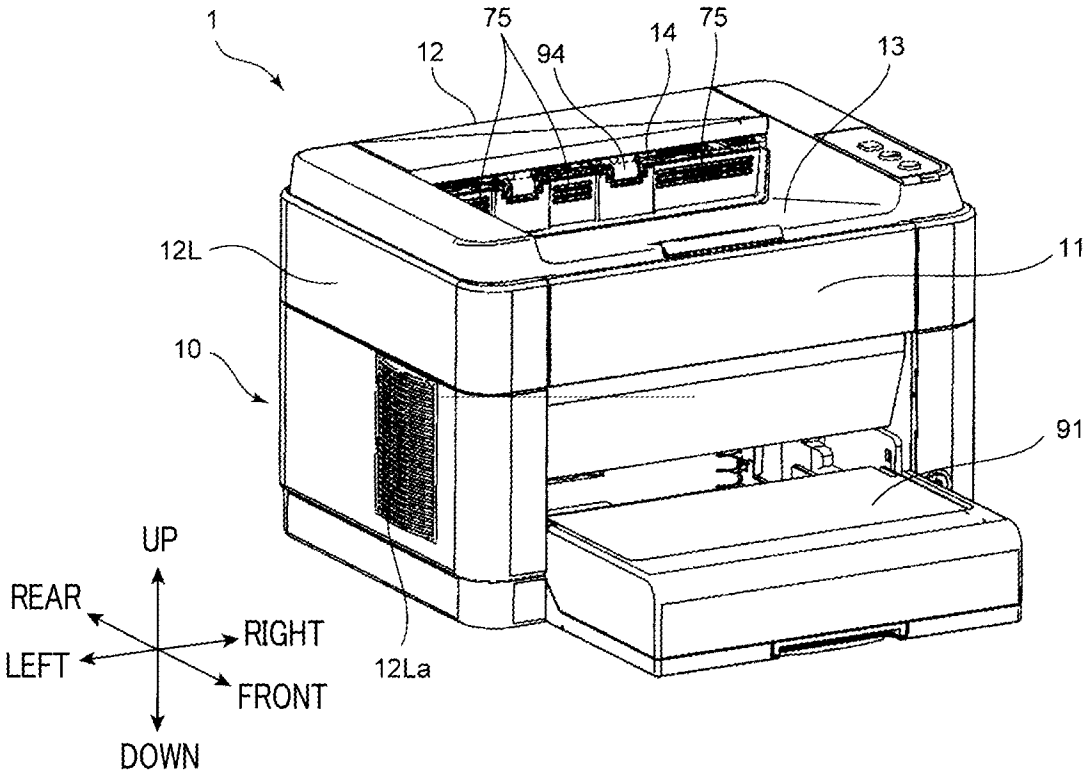
FIG. 1 is a perspective view of an external appearance of an image forming apparatus according to one embodiment of the present disclosure.
Figure 2:
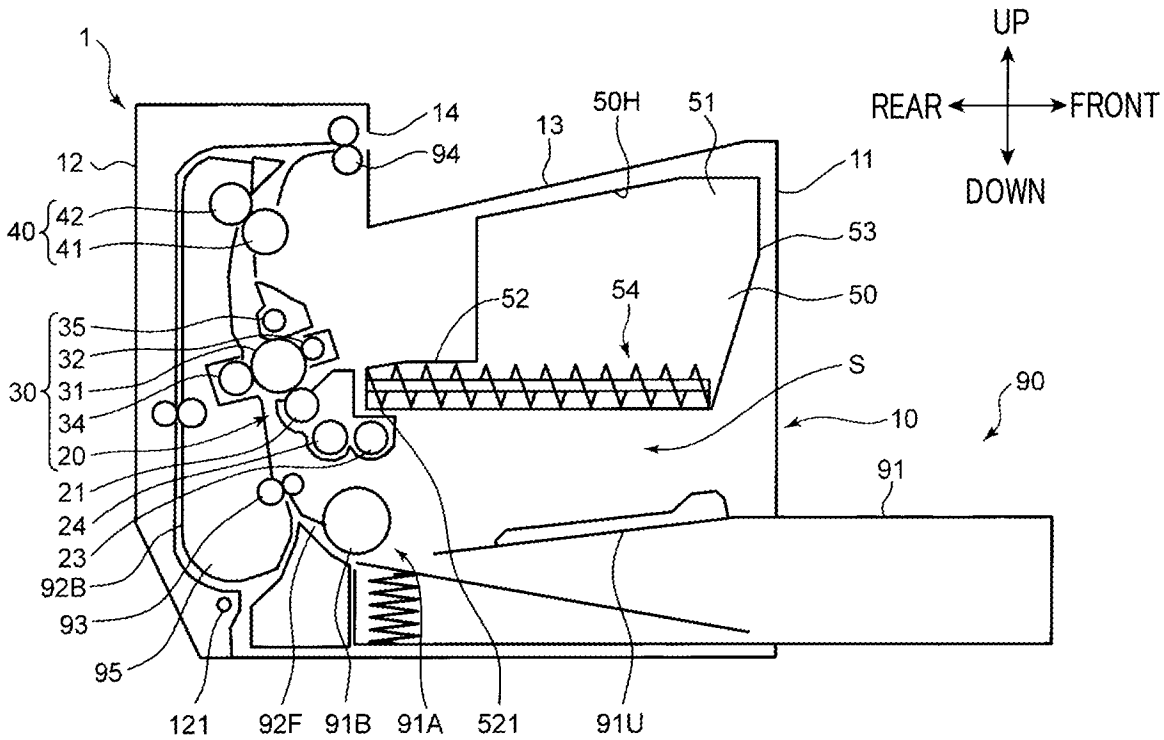
FIG. 2 is a cross-sectional view of an internal structure of the image forming apparatus according to one embodiment of the present disclosure.

Hereinafter, embodiments of the present disclosure will be described in detail with reference to the drawings. FIG. 1 is a perspective view of an external appearance of an image forming apparatus 1 according to one embodiment of the present disclosure. FIG. 2 is a sectional side view of an internal structure of the image forming apparatus 1 according to one embodiment of the present disclosure. In the description herein, as the image forming apparatus 1, a black and white printer is illustrated. However, the image forming apparatus may be a copy machine, a facsimile apparatus, or a multifunction peripheral having a portion or the entirety of functions of those machines and apparatuses. Further, an image forming apparatus that forms color images may be used.

The image forming apparatus 1 includes a main body housing 10 structured as an almost rectangular parallelepiped housing, and includes, in the main body housing 10, an image forming portion 30, a fixing portion 40, a toner container 50, and a sheet feed portion 90.

A front cover 11 and a rear cover 12 are provided on the front surface side and the rear surface side, respectively, of the main body housing 10. When the front cover 11 is opened, the toner container 50 is exposed on the front surface side. Thus, a user is allowed to take out the toner container 50 from the main body housing 10 on the front surface side when toner is consumed. The rear cover 12 is opened at occurrence of sheet jam, or for maintenance. Units of the image forming portion 30 and the fixing portion 40 can be taken out from the main body housing 10 on the rear surface side when the rear cover 12 is opened.

Further, on the side surfaces of the main body housing 10, a left cover 12L (FIG. 1) and a right cover 12R (not shown in FIG. 1) on a side opposite to the left cover 12L side, are provided. Each of the left cover 12L and the right cover 12R is disposed so as to extend in the vertical direction. An air inlet 12La through which air is drawn into the main body housing 10 is formed in a front portion of the left cover 12L. Further, a sheet discharge portion 13 onto which a sheet having an image formed thereon is discharged is provided on the top surface of the main body housing 10. Various devices that execute image formation are mounted in an internal space S (FIG. 2) defined by the front cover 11, the rear cover 12, the left cover 12L, the right cover 12R, and the sheet discharge portion 13.

The image forming portion 30 performs image forming process in which a toner image is formed on a sheet fed by the sheet feed portion 90. The image forming portion 30 includes a photosensitive drum 31 (image carrier), and includes a charging device 32, an exposure device (which is not shown in FIG. 2), a developing apparatus 20, a transfer roller 34, and a cleaning device 35, which are disposed around the photosensitive drum 31. The image forming portion 30 is disposed between the left cover 12L and the right cover 12R.

The photosensitive drum 31 includes a rotation shaft and a cylindrical surface that rotates about the rotation shaft. On the cylindrical surface, an electrostatic latent image is formed, and a toner image corresponding to the electrostatic latent image is carried on the cylindrical surface. As the photosensitive drum 31, a photosensitive drum formed by an amorphous-silicon-(a-Si)-based material, may be used.

By the charging device 32, the surface of the photosensitive drum 31 is uniformly charged. The charging device 32 includes a charging roller that abuts the photosensitive drum 31.

The cleaning device 35 includes a not-illustrated cleaning blade, and removes, for cleaning the photosensitive drum 31, toner attached to the circumferential surface of the photosensitive drum 31 from which a toner image has been transferred, and conveys the removed toner to a not-illustrated recovery device.

The exposure device includes a laser light source and optical devices such as a mirror and a lens, and applies, to the circumferential surface of the photosensitive drum 31, light modulated based on image data obtained from an external device such as a personal computer, to form an electrostatic latent image. The developing apparatus 20 supplies toner to the circumferential surface of the photosensitive drum 31 in order to develop the electrostatic latent image on the photosensitive drum 31 and form a toner image. The developing apparatus 20 includes a developing roller 21 that carries toner to be supplied to the photosensitive drum 31, and a first agitating screw 24 and a second agitating screw 23 that circulate and convey, in a development housing 210 (FIG. 3), developer while agitating the developer. The developing apparatus 20 of the present embodiment will be described below in detail.

The transfer roller 34 is a roller that transfers, to a sheet, the toner image formed on the circumferential surface of the photosensitive drum 31. The transfer roller 34 abuts the cylindrical surface of the photosensitive drum 31, thereby forming a transfer nip portion. Transfer bias having a polarity opposite to that of the toner is applied to the transfer roller 34.

The fixing portion 40 performs a fixing process in which the transferred toner image is fixed onto a sheet. The fixing portion 40 includes a fixing roller 41 having a heat source thereinside, and a pressurizing roller 42 that is pressed against the fixing roller 41, to form a fixing nip portion between the pressurizing roller 42 and the fixing roller 41. When the sheet having the toner image transferred thereto passes through the fixing nip portion, the toner image is heated by the fixing roller 41 and pressurized by the pressurizing roller 42, to be fixed onto the sheet.

The toner container 50 (additional-developer storage portion) stores toner to be additionally supplied to the developing apparatus 20. The toner container 50 includes: a container body 51 that is a main storage portion for additional toner to be supplied; a cylindrical portion 52 that projects from a lower portion of one side surface of the container body 51; a lid member 53 that covers the other side surface of the container body 51; and a rotating member 54, accommodated in the container, which conveys toner. The additional toner stored in the toner container 50, is supplied, into the developing apparatus 20, through a toner outlet 521 that is disposed at the bottom surface of the end portion of the cylindrical portion 52, by the rotating member 54 being driven to rotate. Further, a container top cover 50H that covers the upper portion of the toner container 50 is positioned below the sheet discharge portion 13 (see FIG. 2).

The sheet feed portion 90 includes a sheet feed cassette 91 that stores sheets on which image forming process is to be performed (FIG. 2). A portion of the sheet feed cassette 91 projects forward from the front surface of the main body housing 10. A portion, of the sheet feed cassette 91, which is accommodated in the main body housing 10 has a top surface covered with a sheet feed cassette top cover 91U. The sheet feed cassette 91 has: a sheet storage space in which a bundle of sheets is stored; a lifting plate that lifts the bundle of sheets for feeding the sheets; and the like. A sheet feeding portion 91A is formed above the rear end portion of the sheet feed cassette 91. In the sheet feeding portion 91A, a sheet feed roller 91B that operates to feed one by one sheets on the uppermost layer of the bundle of sheets in the sheet feed cassette 91, is formed In the main body housing 10, a main conveying path 92F and a reverse conveying path 92B, for conveying a sheet, are formed. The main conveying path 92F extends from the sheet feeding portion 91A of the sheet feed portion 90 through the image forming portion 30 and the fixing portion 40 to a sheet discharge outlet 14 that opposes the sheet discharge portion 13 on the top surface of the main body housing 10. The reverse conveying path 92B is a conveying path through which a sheet on which one-side printing has been performed is returned to the upstream side of the image forming portion 30 in the main conveying path 92F when double-side printing is performed for the sheet.

The main conveying path 92F extends so as to pass through the transfer nit portion formed by the photosensitive drum 31 and the transfer roller 34, from the lower side toward the upper side. Further, a pair of registration rollers 93 is disposed upstream of the transfer nit portion in the main conveying path 92F. The sheet is temporarily stopped at the pair of registration rollers 93, to perform skew correction for the sheet, and is thereafter fed to the transfer nit portion at a predetermined time for image transfer. A plurality of conveying rollers for conveying sheets are disposed at appropriate positions in the main conveying path 92F and the reverse conveying path 92B. For example, a pair of sheet discharge rollers 94 is disposed near the sheet discharge outlet 14.

The reverse conveying path 92B is formed between an outer side surface of a reversing unit 95 and an inner surface of the rear cover 12 of the main body housing 10. In inner side surfaces of the reversing unit 95, the transfer roller 34 and one of the paired registration rollers 93 are disposed. The rear cover 12 and the reversing unit 95 are each pivotable about a shaft of a pivot portion 121 disposed at the lower ends of the rear cover 12 and the reversing unit 95. When sheet jam occurs in the reverse conveying path 92B, the rear cover 12 is opened. When sheet jam occurs in the main conveying path 92F, or when units of the photosensitive drum 31 or the developing apparatus 20 are taken out, the reversing unit 95 in addition to the rear cover 12 is opened.

<Developing Apparatus>

Figure 3:
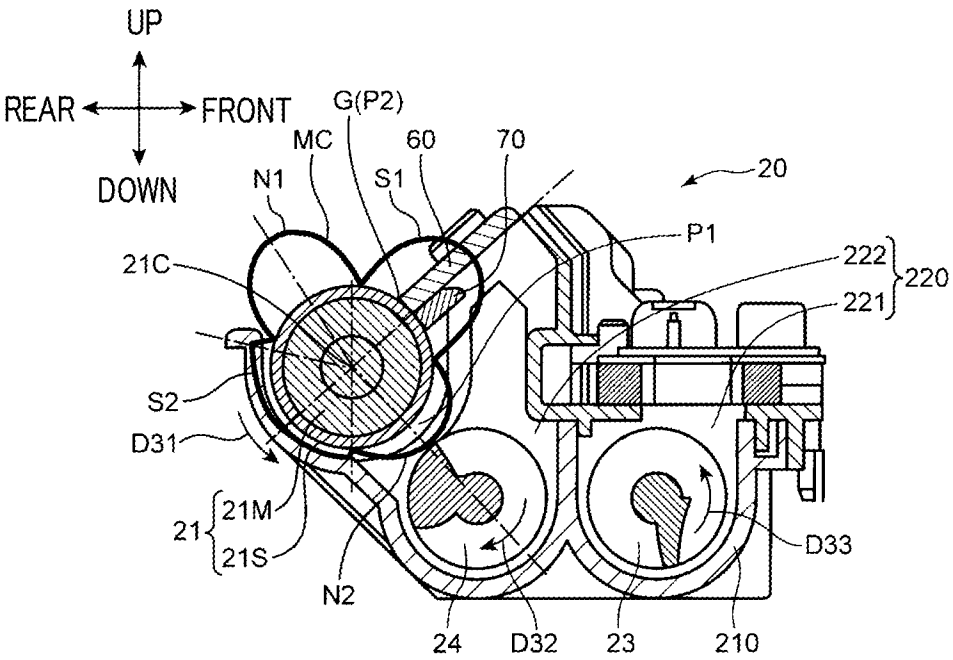
FIG. 3 is a cross-sectional view of a developing apparatus, as viewed from the side thereof, according to a first embodiment of the present disclosure.
Figure 4:
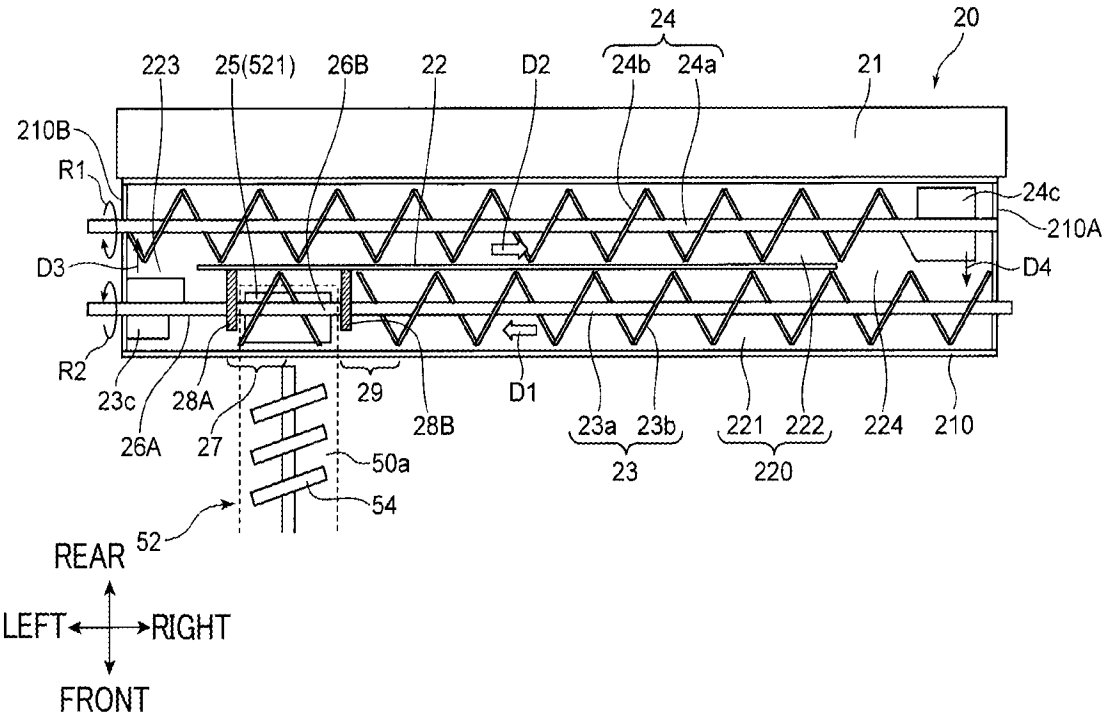
FIG. 4 is a plan view of the developing apparatus according to the first embodiment of the present disclosure.

Next, the developing apparatus 20 according to a first embodiment of the present disclosure will be described in detail. FIG. 3 is a cross-sectional view of an internal structure of the developing apparatus 20. FIG. 4 is a plan view of the internal structure of the developing apparatus 20. The developing apparatus 20 includes the development housing 210 (housing) that has a box-like shape having a longitudinal dimension in one direction (axial direction of the developing roller 21). The development housing 210 includes a first wall portion 210A and a second wall portion 210B (FIG. 4) that are paired. The development housing 210 includes an internal space 220 between the first wall portion 210A and the second wall portion 210B. Further, the development housing 210 includes a top cover 211 (FIG. 5) that defines the top of the internal space 220.

In the internal space 220, the developing roller 21, the first agitating screw 23 (conveying member) and the second agitating screw 24, and a toner supply inlet 25 (developer reception opening) are disposed. In the present embodiment, a one-component development mode in which the internal space 220 is filled with toner, as developer, including a magnetic material, is used. Toner is agitated and conveyed in the internal space 220, and is sequentially supplied from the developing roller 21 to the photosensitive drum 31 in order to develop an electrostatic latent image.

The developing roller 21 is rotatably supported, by the development housing 210, between the first wall portion 210A and the second wall portion 210B that are paired, and the developing roller 21 carries developer on the surface thereof. The developing roller 21 has a cylindrical shape that extends in the longitudinal direction of the development housing 210. The developing roller 21 includes a sleeve 21S that has a cylindrical shape and is driven to rotate, and a magnet 21M that has a circular-column-like shape and is fixedly disposed inside the sleeve 21S along the axial direction. The sleeve 21S is driven, by not-illustrated driving means, to rotate in the direction indicated by an arrow D31 shown in FIG. 3, and carries magnetic toner on the circumferential surface thereof. The magnet 21M is a stationary magnet having, inside the sleeve 21S, a plurality of magnetic poles in the circumferential direction of the sleeve 21S. The magnet 21M has four magnetic poles, an S1 pole, an N1 pole, an S2 pole, and an N2 pole, arranged in the circumferential direction.

In FIG. 3, a curved line MC surrounding the developing roller 21 represents magnetic forces, in the radial direction, of the developing roller 21, as a distribution of the magnetic forces in the circumferential direction on the sleeve 21S, and the magnetic forces, in the radial direction, of the developing roller 21 are generated by each magnetic pole. The S1 pole is positioned in a front upper portion of the magnet 21M. The S1 pole is used as a regulation pole to regulate a toner layer. The N1 pole is positioned in a rear upper portion of the magnet 21M. The N1 pole acts as a developing pole to supply toner to the photosensitive drum 31. The N2 pole is positioned in a front lower portion of the magnet 21M. The N2 pole acts as a catching pole to scoop toner toward the developing roller 21. The S2 pole is positioned, in the magnet 21M, downstream of the N1 pole in the rotation direction of the sleeve 21S, and upstream of the N2 pole in the rotation direction of the sleeve 21S. The S2 pole is mainly positioned in a rear lower portion of the magnet 21M. The S2 pole acts as a conveying pole to recover, into the development housing 210, toner that has not been conveyed to the photosensitive drum 31 by means of the N1 pole. The toner carried on the sleeve 21S is conveyed to an opening (not shown) disposed in the development housing 210, and supplied to the photosensitive drum 31 opposing the development housing 210.

The internal space 220 in the development housing 210 is covered with the top cover 211 (FIG. 5), and is divided, by a divider 22 extending in the left-right direction, into a first conveying path 221 and a second conveying path 222 each of which has a longitudinal dimension in the left-right direction. The divider 22 has a width that is less than the width, in the left-right direction, of the development housing 210. Thus, a first communication path 223 is disposed between the left end of the divider 22 and the second wall portion 210B, and a second communication path 224 is disposed between the right end of the divider 22 and the first wall portion 210A, such that the first conveying path 221 and the second conveying path 222 communicate with each other. Therefore, in the internal space 220, a circulation path (developer conveying path) is formed in which the first conveying path 221, the first communication path 223, the second conveying path 222, and the second communication path 224 are formed. Toner is conveyed clockwise in FIG. 4 in the circulation path.

The toner supply inlet 25 is an opening that is a hole formed in the top cover 211, and is disposed above a region near the left end (the downstream side in the first direction) of the first conveying path 221 (FIG. 4). The toner supply inlet 25 is disposed so as to oppose the circulation path, and has a function of receiving toner that is additionally supplied from the toner container 50, and supplying the toner into the internal space 220. In the present embodiment, the toner supply inlet 25 is a 14 mm×8 mm opening as viewed in a planar manner.

The first agitating screw 23 is disposed in the first conveying path 221. The first agitating screw 23 includes a first rotation shaft 23*a* (rotation axis), and first helical blades 23*b* (screw blades) that are helically disposed so as to project on the circumference of the first rotation shaft 23*a*. The first agitating screw 23 is driven to rotate about the first rotation shaft 23*a* (in the direction indicated by an arrow D33 in FIG. 3, the direction indicated by an arrow R2 in FIG. 4) by not-illustrated driving means, to convey toner in the direction (the first direction) indicated by an arrow D1 in FIG. 4. The first agitating screw 23 conveys developer such that the developer passes by a position where the toner supply inlet 25 opposes the first conveying path 221. Thus, the first agitating screw 23 functions to mix toner that is additionally supplied through the toner supply inlet 25, and toner being conveyed in the first conveying path 221, and deliver the mixed toner toward the second conveying path 222. In the present embodiment, the outer diameter of each first helical blade 23*b* is set as 14 mm, and a pitch, in the axial direction, for the first helical blades 23*b* is set as 20 mm. The pitch may be determined according to a conveying performance of the first agitating screw 23. However, the lower limit of the pitch is preferably 15 mm in order to maintain the toner conveying capability. A first paddle 23*c* is disposed on the downstream side, in the toner conveying direction (the direction indicated by the arrow D1), of the first agitating screw 23. The first paddle 23*c* is a plate-like member disposed on the first rotation shaft 23*a*. The first paddle 23*c* rotates with the first rotation shaft 23*a*, and delivers toner from the first conveying path 221 to the second conveying path 222 in the direction indicated by an arrow D3 in FIG. 4. In the present embodiment, the length, in the axial direction, of the first paddle 23*c* is set as 20 mm. Further, the first agitating screw 23 includes a first shaft portion 26A and a second shaft portion 26B (elimination portions). In each of the first shaft portion 26A and the second shaft portion 26B, the first helical blades 23*b* are locally eliminated, and only the first rotation shaft 23*a* is provided. A downstream-side reduction wall 28A and an upstream-side reduction wall 28B, which are described below, are disposed so as to oppose the first shaft portion 26A and the second shaft portion 26B.

The second agitating screw 24 is disposed in the second conveying path 222. The second agitating screw 24 includes a second rotation shaft 24*a*, and second helical blades 24*b* that are helically disposed so as to project on the circumference of the second rotation shaft 24*a*. The second agitating screw 24 is driven to rotate about the second rotation shaft 24*a* (in the direction indicated by an arrow D32 in FIG. 3, the direction indicated by an arrow R1 in FIG. 4) by not-illustrated driving means, to convey toner in the direction (the second direction) indicated by an arrow D2 in FIG. 4. The second agitating screw 24 conveys toner in the second conveying path 222, and supplies the toner to the developing roller 21. In the present embodiment, the outer diameter of each second helical blade 24*b* is set as 14 mm, and the pitch, in the axial direction, for the second helical blades 24*b* is set as 20 mm. The pitch may be determined according to a conveying performance of the second agitating screw 24. However, the lower limit of the pitch is preferably 15 mm in order to maintain the toner conveying capability.

The second agitating screw 24 is disposed in front of and below the developing roller 21. Namely, the second agitating screw 24 is disposed so as to oppose the N2 pole of the magnet 21M. Toner is supplied from the second agitating screw 24 to the sleeve 21S according to rotation of the second agitating screw 24 (in the direction indicated by the arrow D32 in FIG. 3). The rotation shaft 24*a* of the second agitating screw 24 is disposed below the rotation shaft of the sleeve 21S. Further, the rotation shaft 24*a* of the second agitating screw 24 is disposed below the lower end portion of the circumferential surface of the sleeve 21S. In the present embodiment, a toner supply path to the developing roller 21 is formed by only a supply path by the second agitating screw 24. Therefore, toner is scooped by the second agitating screw 24 toward the developing roller 21 from the lower side to the upper side, thereby supplying toner to the sleeve 21S.

A second paddle 24*c* is disposed on the downstream side, in the toner conveying direction (the direction indicated by the arrow D2), of the second agitating screw 24. The second paddle 24*c* is a plate-like member disposed on the second rotation shaft 24*a*. The second paddle 24*c* rotates with the second rotation shaft 24*a*, and delivers toner from the second conveying path 222 to the first conveying path 221 in the direction indicated by an arrow D4 in FIG. 4. In the present embodiment, the length, in the axial direction, of the second paddle 24*c* is set as 20 mm.

The developing apparatus 20 further includes a layer regulation member 60 and a magnet plate 70.

The layer regulation member 60 is disposed in front of and above the developing roller 21. The layer regulation member 60 is disposed along the axial direction of the developing roller 21 so as to oppose the circumferential surface of the developing roller 21 (the sleeve 21S). Specifically, the layer regulation member 60 is disposed above the developing roller 21 so as to oppose the S1 pole of the magnet 21M. The layer regulation member 60 is a plate-like member formed by a magnetic material. The layer regulation member 60 has a rectangular shape having a long side in the direction toward the developing roller 21, on a cross-section orthogonal to the rotation axis of the developing roller 21. The end portion of the layer regulation member 60 is spaced from the sleeve 21S of the developing roller 21. As a result, a layer regulation gap G is formed between the end portion and the sleeve 21S. The layer regulation member 60 functions to regulate the thickness of a layer of toner scooped from the second agitating screw 24 onto the sleeve 21S.

The magnet plate 70 is disposed along and in front of the layer regulation member 60. In other words, the magnet plate 70 is disposed upstream of the layer regulation member 60 in the rotation direction (the direction indicated by an arrow D31 in FIG. 3) of the sleeve 21S of the developing roller 21. In the present embodiment, the magnet plate 70 is formed as a permanent magnet having a plate-like shape. The magnet plate 70 has almost a rectangular shape that extends along the layer regulation member 60, on a cross-section orthogonal to the rotation axis of the developing roller 21. The magnet plate 70 is fixed to the lower portion of the layer regulation member 60. The magnet plate 70 has a magnetic force of an S pole that has the same polarity as the S1 pole, at a position opposing the S1 pole of the magnet 21M. Further, the magnet plate 70 has an N pole at a position that is further from the S1 pole of the magnet 21M than the position of the S pole is.

Thus, in the present embodiment, the magnet plate 70 is disposed upstream of the layer regulation member 60 in the rotation direction of the developing roller 21 (the sleeve 21S). In other words, the magnet plate 70 and the layer regulation member 60 are disposed in order, respectively, from the upstream side toward the downstream side in the rotation direction of the developing roller 21, so as to oppose the circumferential surface of the developing roller 21.

The second agitating screw 24 supplies toner toward a first position P1, on the circumferential surface of the sleeve 21S, which faces vertically downward, to supply toner to the sleeve 21S. The layer regulation member 60 regulates a thickness of toner on the sleeve 21S at a second position P2, on the circumferential surface of the sleeve 21S, which is located above the first position P1 and faces vertically upward. At this time, the S1 pole of the magnet 21M and the S pole of the magnet plate 70 have magnetic forces, respectively, of the same polarity, whereby a repelling magnetic field is generated between the sleeve 21S and the magnet plate 70. The repelling magnetic field is divided into a magnetic field toward the upstream side in the rotation direction of the sleeve 21S, and a magnetic field toward the downstream side (the layer regulation member 60 side) in the rotation direction of the sleeve 21S. Therefore, to toner conveyed on the sleeve 21S to under the magnet plate 70, a force for moving the toner on the circumferential surface of the sleeve 21S is applied. As a result, in a state where a layer of the toner is thin, toner layer regulation can be performed. Further, toner that has not entered the layer regulation gap G of the layer regulation member 60 is promoted by the repelling magnetic field to move toward the upstream side in the rotation direction of the sleeve 21S.

<Accumulation Portion>

The toner container 50 described above is disposed above the toner supply inlet 25 of the development housing 210. The toner container 50 includes thereinside a toner conveying path 50*a* in which toner is conveyed, the rotating member 54, and the toner outlet 521. The toner container 50 is mounted to the developing apparatus 20 such that the longitudinal direction (the direction in which the toner conveying path 50*a* extends) of the toner container 50 is orthogonal to the longitudinal direction (the direction in which developer is conveyed by the first agitating screw 23, the direction indicated by the arrow D1, the first direction) of the developing apparatus 20.

The toner outlet 521 is disposed at the bottom portion of the toner container 50 so as to correspond to the toner supply inlet 25 of the developing apparatus 20. The rotating member 54 has a shaft portion and a blade portion that rotates about the shaft portion (see FIG. 2, FIG. 4), and conveys additional toner in the toner conveying path 50*a* toward the toner outlet 521. Toner that falls from the toner outlet 521 is supplied to the developing apparatus 20 through the toner supply inlet 25.

Figure 5:
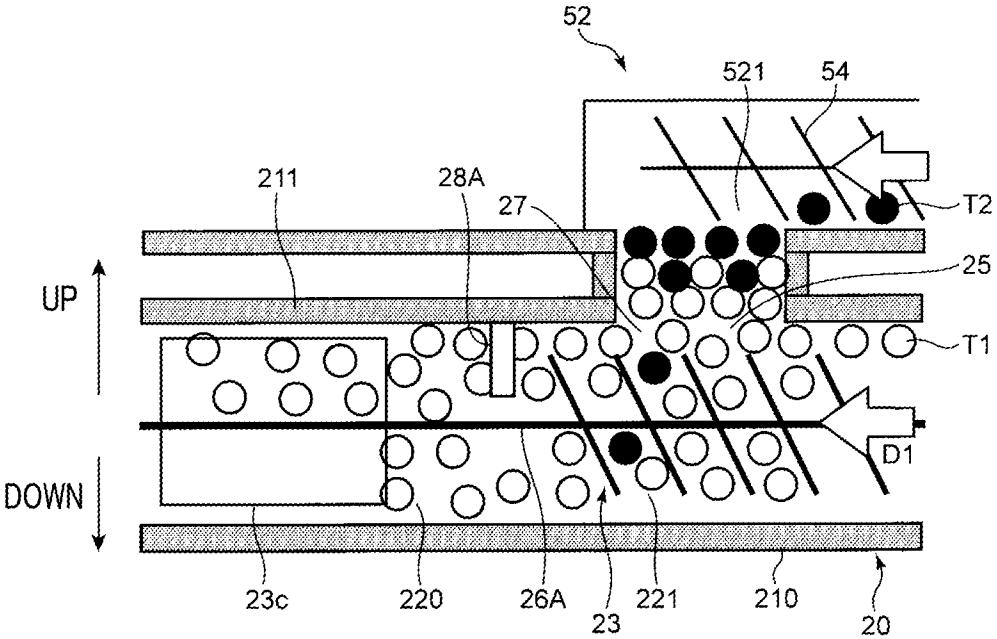
FIG. 5 is a schematic diagram illustrating a state where toner is supplied, in the developing apparatus according to the first embodiment of the present disclosure.
Figure 6:
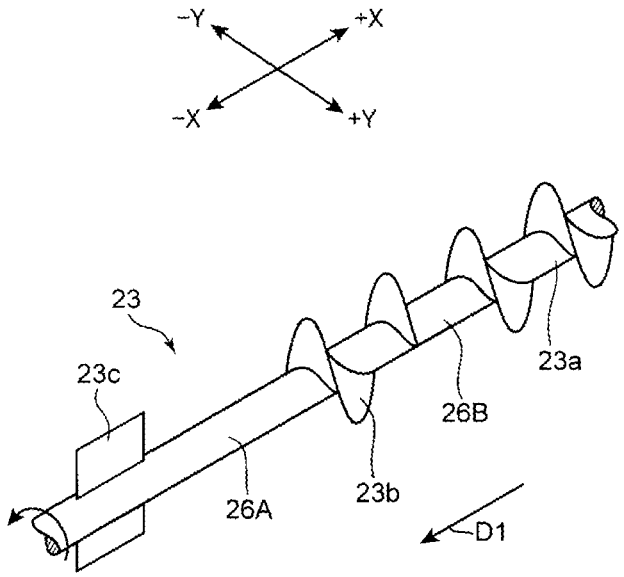
FIG. 6 is an enlarged perspective view of a first agitating screw of the developing apparatus according to the first embodiment of the present disclosure.

Next, a flow of supply of new toner through the toner supply inlet 25 into the developing apparatus 20 according to the present embodiment will be described. FIG. 5 is a cross-sectional view of a portion near the toner supply inlet 25 disposed in the developing apparatus 20 and the toner outlet 521 disposed in the toner container 50. For the convenience of description, FIG. 5 shows the toner container 50 that is rotated 90 degrees in the horizontal direction. The rotating member 54 in the toner container 50 actually extends toward the near side of the surface of the sheet of FIG. 5, and the first agitating screw 23 and the rotating member 54 in the toner container 50 are disposed so as to be orthogonal to each other. Further, FIG. 6 is an enlarged perspective view of a portion of the first agitating screw 23.

Additional toner T2 supplied through the toner outlet 521 of the toner container 50, falls into the first conveying path 221, is mixed with existing toner T1, and is conveyed in the direction indicated by the arrow D1 by the first agitating screw 23. At this time, the toner T1 and the toner T2 are agitated and electrically charged.

In the first agitating screw 23, the first shaft portion 26A that locally reduces developer conveying performance is provided downstream of the toner supply inlet 25 in the toner conveying direction. The first shaft portion 26A is formed by eliminating the first helical blades 23*b* of the first agitating screw 23 (see FIG. 6). In the present embodiment, the length, in the axial direction, of the first shaft portion 26A is set as 12 mm. In other words, the first shaft portion 26A corresponds to a portion locally formed by only the first rotation shaft 23*a*. In this case, the first shaft portion 26A does not have a function of conveying developer in the axial direction of the first rotation shaft 23*a*.

Further, the developing apparatus 20 includes a downstream-side reduction wall 28A (downstream-side conveying capability reduction portion). The downstream-side reduction wall 28A is a wall portion that is disposed downstream of the toner supply inlet 25 in the first direction (the direction indicated by the arrow D1) so as to project downward from the top cover 211 of the development housing 210. The downstream-side reduction wall 28A is disposed such that the lower end of the downstream-side reduction wall 28A is closer to the first rotation shaft 23*a* than the outer diameter end of the first helical blades 23*b* of the first agitating screw 23 is. As described above, the downstream-side reduction wall 28A is disposed so as to oppose the first shaft portion 26A, thereby preventing the first agitating screw 23 and the downstream-side reduction wall 28A from interfering with each other. In this structure, toner accumulation portions can be stably formed upstream and downstream of the toner supply inlet 25 by the downstream-side reduction wall 28A and the upstream-side reduction wall 28B.

In the first conveying path 221, toner conveyed from a region upstream of the downstream-side reduction wall 28A hits against the downstream-side reduction wall 28A, and starts to be accumulated. Toner is accumulated at a position, immediately upstream of the downstream-side reduction wall 28A, at which the toner supply inlet 25 opposes the first conveying path 221, and in a region preceding the position. As a result, a downstream-side accumulation portion 27 (first accumulation portion) for developer is formed near the entrance of the toner supply inlet 25.

When an amount of toner in the internal space 220 is increased due to the additional toner T2 being supplied through the toner supply inlet 25, the toner supply inlet 25 is blocked (sealed) with toner accumulated in the downstream-side accumulation portion 27, to reduce additional supply of toner. Thereafter, when toner in the internal space 220 is consumed by the developing roller 21, and toner accumulated in the downstream-side accumulation portion 27 is reduced, toner with which the toner supply inlet 25 is blocked is reduced, whereby a gap is generated between the downstream-side accumulation portion 27 and the toner supply inlet 25. As a result, the additional toner T2 enters the internal space 220 again through the toner supply inlet 25. Thus, in the present embodiment, a volume-based toner supply mode is used in which a received amount of toner to be additionally supplied, is adjusted according to reduction of toner accumulated in the downstream-side accumulation portion 27.

<Dispersion of Additionally Supplied Toner>

Figure 9:
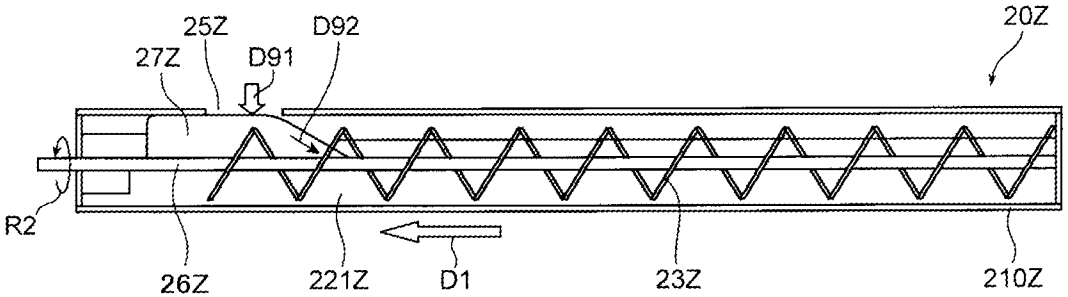
FIG. 9 is a cross-sectional view illustrating distribution of developer in a developing apparatus as compared to the developing apparatus according to the first embodiment of the present disclosure.

Next, a problem with supply of toner by a developing apparatus 20Z as compared to supply of toner in the present embodiment will be described. FIG. 9 is a cross-sectional view of the developing apparatus 20Z. FIG. 9 shows a first conveying path 221Z as viewed from the side thereof. The developing apparatus 20Z also includes a conveying capability reduction portion 26Z in which helical blades are locally eliminated, as in the developing apparatus 20 of the present embodiment. The conveying capability reduction portion 26Z does not have a conveying capability in the axial direction, whereby a downstream-side accumulation portion 27Z is formed in a region opposing a toner supply inlet 25Z. Toner is additionally supplied from a not-illustrated toner container to the toner supply inlet 25Z according to an amount of toner in the downstream-side accumulation portion 27Z (an arrow D91).

In the developing apparatus 20Z having the volume-based toner supply mode as described above, when toner remaining in the toner container is reduced, an amount of supplied toner is reduced, thereby reducing an amount of toner in a development housing 210Z. In this case, when it is determined, by a not-illustrated density sensor, that an amount of remaining toner is small, exchange of the toner containers is prompted. At this time, since an amount of toner in the development housing 210Z is small, an amount of toner in the downstream-side accumulation portion 27Z located downstream of the toner supply inlet 25Z is also small. Additional toner enters the development housing 210Z from a new toner container mounted, by a user, to the developing apparatus 20Z. The new toner container is filled with a large amount of toner, and therefore the additional toner is likely to rapidly enter the development housing 210Z.

Toner that has entered the development housing 210Z enters the downstream-side accumulation portion 27Z. The toner is conveyed to a second conveying path 222Z (not shown) that communicates with a first conveying path 221Z, according to a first agitating screw 23Z being driven to rotate. At this time, a surface state or an electrically charged state may be different between a large amount of additional toner that has been supplied to the development housing 210Z from the new toner container, and existing toner having been circulated in the development housing 210Z, in many cases. Although the additional toner and the existing toner are circulated in the development housing 210Z, to gradually have approximate characteristics, the toner may be charged so as to be polarized into two poles, due to difference in surface state between the additional toner and the existing toner, immediately after the entering of the additional toner. Namely, one of the additional toner and the existing toner is positively charged, and the other thereof is negatively charged. As a result, developer fogging may occur in an image on the photosensitive drum 31 and on a sheet. In particular, in the developing apparatus 20Z shown in FIG. 9, additional toner supplied through the toner supply inlet 25Z may enter a region upstream of the toner supply inlet 25Z as indicated by an arrow D92. In this case, since space is large around the first agitating screw 23Z in a region upstream of the toner supply inlet 25Z, unlike in the downstream-side accumulation portion 27Z located downstream of the toner supply inlet 25Z, a large amount of additional toner is likely to enter the development housing 210Z.

In addition, additionally supplied toner, which rapidly enters the development housing 210Z, is less likely to sink toward the bottom portion of the development housing 210Z even if a rotational force of the first agitating screw 23Z is applied. In particular, in the conveying capability reduction portion 26Z located downstream of the toner supply inlet 25Z, toner agitating capability is reduced, so that toner dispersion becomes more difficult. In this case, the additional toner that has entered the development housing 210Z, enters the second conveying path 222Z through a first communication path 223Z (not shown) while moving over the surface layer (the upper layer, a draft surface portion) of the toner layer in the first conveying path 221Z. If toner that has entered the second conveying path 222Z without sufficiently dispersing, is supplied as a lump to a developing roller 21Z (not shown) as it is, a problem arises that vertically-striped developer fogging occurs in an image.

Downstream-Side Reduction Wall 28A and Upstream-Side Reduction Wall 28B>

Figure 7:
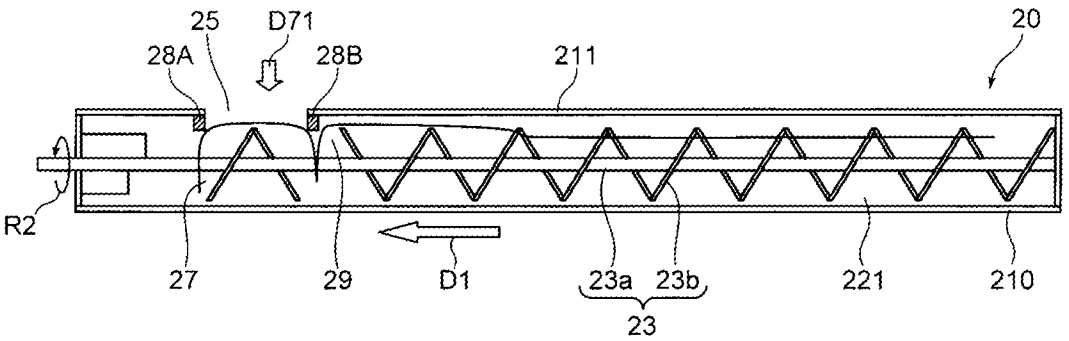
FIG. 7 is a cross-sectional view illustrating distribution of developer in the developing apparatus according to the first embodiment of the present disclosure.

The developing apparatus 20 according to the present embodiment includes the downstream-side reduction wall 28A and the upstream-side reduction wall 28B (upstream-side conveying capability reduction portion) as described above. FIG. 7 is a cross-sectional view illustrating distribution of developer in the developing apparatus 20 according to the present embodiment. As shown in FIG. 4 and FIG. 7, the upstream-side reduction wall 28B is a wall portion that is disposed upstream of the toner supply inlet 25 in the first direction so as to project from the top cover 211 toward the first agitating screw 23. The upstream-side reduction wall 28B locally reduces toner conveying capability of the first agitating screw 23, thereby forming an upstream-side accumulation portion 29 (second accumulation portion) in which toner is accumulated upstream of the toner supply inlet 25 in the first direction.

As shown in FIG. 4 and FIG. 7, the downstream-side reduction wall 28A and the upstream-side reduction wall 28B are each a wall portion that projects downward from the top cover 211 so as to have a predetermined height in the downward direction. Further, the downstream-side reduction wall 28A and the upstream-side reduction wall 28B are each a wall portion that is disposed above the first agitating screw 23 so as to have a predetermined width in the direction (front-rear direction, a direction orthogonal to the first rotation shaft 23*a*) from the first agitating screw 23 toward the developing roller 21. Further, the back end portions of the downstream-side reduction wall 28A and the upstream-side reduction wall 28B are connected to the divider 22.

As shown in FIG. 7, the downstream-side accumulation portion 27 is formed, in a region that opposes the toner supply inlet 25, by the downstream-side reduction wall 28A disposed downstream of the toner supply inlet 25 of the development housing 210. Further, the upstream-side accumulation portion 29 is formed upstream of the toner supply inlet 25 by the upstream-side reduction wall 28B located upstream of the toner supply inlet 25. Therefore, toner can be stably distributed upstream and downstream of the toner supply inlet 25 without depending on an amount of toner in the development housing 210.

In FIG. 7, even when an amount of toner in the downstream-side accumulation portion 27 is reduced, a downstream-side portion of the toner supply inlet 25 is blocked by the downstream-side reduction wall 28A. Further, an upstream-side portion of the toner supply inlet 25 is blocked by the upstream-side reduction wall 28B and the upstream-side accumulation portion 29. Therefore, a stable amount of additional toner is supplied into the development housing 210 (an arrow D71 in FIG. 7) according to reduction of toner in the downstream-side accumulation portion 27.

In other words, due to the downstream-side reduction wall 28A, toner is densely distributed upstream of the downstream-side reduction wall 28A, and toner is sparsely distributed downstream of the downstream-side reduction wall 28A. Further, due to the upstream-side reduction wall 28B, toner is densely distributed upstream of the upstream-side reduction wall 28B, and toner is sparsely distributed downstream of the upstream-side reduction wall 28B. Therefore, in a region that opposes the toner supply inlet 25, toner can be maintained sparse on the upstream side and toner can be maintained dense on the downstream side. The additional toner moves into a space in which toner is sparsely distributed, and, in the space, the upstream-side reduction wall 28B is provided, and further toner that has been circulated in the development housing 210 is accumulated upstream of the upstream-side reduction wall 28B in a dense state. Thus, even when a pressure in the toner container 50 is high, toner is not pushed into a region upstream of the upstream-side reduction wall 28B, and toner is distributed near the toner supply inlet 25 in the development housing 210 as uniformly as possible.

Further, in the present embodiment, the downstream-side reduction wall 28A is disposed in an upper portion of a region downstream of the toner supply inlet 25. Therefore, additional toner supplied through the toner supply inlet 25 is conveyed so as to sink under the downstream-side reduction wall 28A due to a rotational force of the first agitating screw 23. Thus, the additional toner is appropriately mixed with toner therearound. In other words, additional toner is less likely to be supplied to the second conveying path 222 and the developing roller 21 in an insufficiently dispersed state while moving over the upper layer (draft surface) of the toner layer in a region downstream of the toner supply inlet 25.

Figure 8:
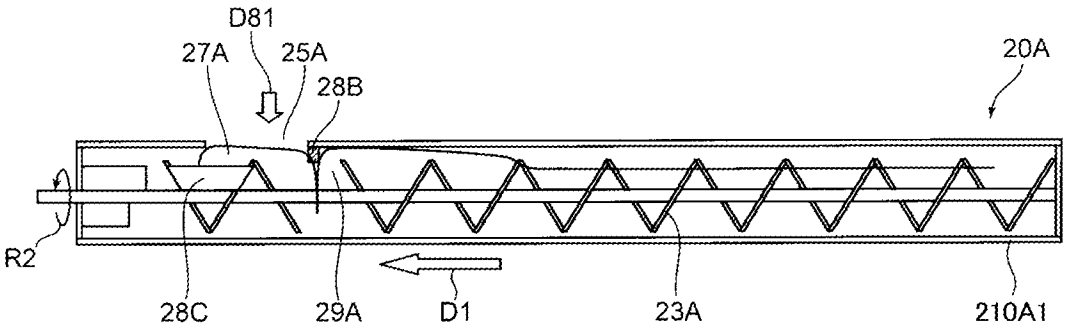
FIG. 8 is a cross-sectional view illustrating distribution of developer in a developing apparatus according to a second embodiment of the present disclosure.

Next, a developing apparatus 20A according to a second embodiment of the present disclosure will be described with reference to FIG. 8. FIG. 8 is a cross-sectional view illustrating distribution of developer in the developing apparatus 20A according to the present embodiment. The developing apparatus 20A of the present embodiment is different from the developing apparatus 20 of the embodiment described above in that the developing apparatus 20A includes a reduction paddle 28C (paddle member, downstream-side conveying capability reduction portion), instead of the downstream-side reduction wall 28A of the developing apparatus 20. Therefore, the difference will be mainly described and description common to both of the embodiments is not given.

The reduction paddle 28C is disposed, in a first agitating screw 23A, downstream of a toner supply inlet 25A in the first direction. The reduction paddle 28C is a rib member that is extended on and between the helical blades adjacent to each other in the first agitating screw 23A. The reduction paddle 28C locally reduces toner conveying capability of the first agitating screw 23A, to form a downstream-side accumulation portion 27A in which toner is accumulated at a position that opposes the toner supply inlet 25A.

In addition, also in the developing apparatus 20A, an upstream-side accumulation portion 29A is formed upstream of the toner supply inlet 25A due to the upstream-side reduction wall 28B disposed upstream of the toner supply inlet 25A. Therefore, toner accumulation portions can be stably formed upstream and downstream of the toner supply inlet 25A without depending on an amount of toner in a development housing 210A1. As a result, a stable amount of additional toner enters the development housing 210A1 (an arrow D81 in FIG. 8) according to reduction of toner in the downstream-side accumulation portion 27A. Therefore, even if an amount of toner in the development housing 210A1 is changed, toner accumulation portions are stably formed upstream and downstream of the toner supply inlet 25A.

EXAMPLES

Next, examples for the first embodiment and the second embodiment of the present disclosure will be described. However, the present disclosure is not restricted by examples described below. Examples described below were implemented under the following experimental conditions.

Experimental Conditions

Photosensitive drum 31: OPC drum

Circumferential speed of photosensitive drum 31: 146 mm/sec

Layer regulation gap G: 0.3 mm

Developing bias AC component: rectangular wave having amplitude of 1.7 kV and duty ratio of 50%

Developing bias DC component: 270V

Surface potential of photosensitive drum 31 (background portion/image portion): 430V/30V Diameter of developing roller 21: 16 mm Diameter of photosensitive drum 31: 24 mm Average particle diameter of magnetic toner: 6.8 μm (D50)

Minimum distance in axial direction between toner supply inlet 25 and first communication path 223: 10 mm Minimum distance in axial direction between toner supply inlet 25 and second communication path 224: 140 mm Experiment 1

Firstly, a new toner container 50 was mounted to the image forming apparatus 1, and an image was continuously printed with the coverage rate being 3.8% until toner was consumed and the toner container 50 became empty. In this state, a new toner container 50 the weight of which was previously obtained was further mounted to the image forming apparatus 1. Printing of 100 white paper sheets was performed, and thereafter stripe fogging was evaluated. The stripe fogging represents fogging that occurs when additionally supplied toner slides over a toner layer, and is supplied to the developing roller 21 in a condensed state. Further, an amount of additional toner that entered the development housing 210 from the toner container 50 when the new toner container 50 was mounted, was evaluated based on a difference between a weight of the development housing 210 before exchange of the toner containers and a weight of the development housing 210 after exchange of the toner containers.

Table 1 indicates results of the stripe fogging and measurement of the weights of the toner container 50. The level of the stripe fogging was evaluated in a background portion of a sheet. As the level of the stripe fogging as described below, "excellent" represents a state where stripe fogging did not occur at all, "good" represents a state where stripe fogging occurred in five paper sheets or less among 100 paper sheets, "standard" represents a state where stripe fogging occurred in 15 paper sheets or less among 100 paper sheets, and "poor" represents a state where stripe fogging occurred in 16 paper sheets or more among 100 paper sheets.

TABLE 1

| | Comparative example 1 | Example 1 | Example 2 |
|---|---|---|---|
| Height H2 (mm) of upstream-side reduction wall 28B | 0 | 2 | 2 |
| Height H1 (mm) of downstream-side reduction wall 28A | 0 | 0 | 2 |
| Reduction paddle 28C | Not provided | Provided | Not provided |
| Weight (g) of toner in development housing before exchange of containers | 60.5 | 58.6 | 57.8 |
| Weight (g) of toner in development housing after exchange of containers | 64.3 | 61.1 | 59.3 |
| Amount of toner (g) that entered | 3.8 | 2.5 | 1.5 |
| Stipe fogging | Poor | Standard | Excellent |

In Table 1, Comparative example 1 represents a structure of the conventional developing apparatus 20Z as shown in FIG. 9. Example 1 represents a structure of the developing apparatus 20, as shown in FIG. 7, according to the first embodiment of the present disclosure. Example 2 represents a structure of the developing apparatus 20A, as shown in FIG. 8, according to the second embodiment of the present disclosure. As indicated in Table 1, in Examples 1 and 2, results of the stripe fogging are better than in Comparative example 1. Further, in Examples 1 and 2, it was confirmed that an amount of toner that entered the development housing 210 when the new toner container 50 was mounted, was reduced as compared to in Comparative example 1.

Experiment 2

Next, evaluation results obtained when the heights, in the downward projecting direction, of the downstream-side reduction wall 28A and the upstream-side reduction wall 28B from the top cover 211 were changed in the structure of the developing apparatus 20, as shown in FIG. 7, according to the first embodiment of the present disclosure, will be described. The development housings 210 that had the downstream-side reduction walls 28A and the upstream-side reduction walls 28B as indicated in Nos. 1 to 7 in Table 2 were prepared, and were each mounted to the image forming apparatus 1 in the environment where the temperature was 24.5° C. and the humidity was 50%. An image was printed on 2000 paper sheets with the coverage rate being 3.8%, thereby applying stress to toner in each development housing 210. Next, the development housings 210 were left as they were, for 60 hours, in the environment where the temperature was 28° C. and the humidity was 80%, thereby enhancing the degradation of the toner. Finally, the development housings 210 that had been left, were left as they were, for one hour, in the environment where the temperature was 24.5° C. and the humidity was 50%. Thereafter, toner that had been stored in the environment where the temperature was 24.5° C. and the humidity was 50%, was additionally supplied, and printing of 100 white paper sheets was performed and an image was printed on 300 paper sheets with the coverage rate being 3.8%, and an F. D (fogging density) was measured. Further, an amount of toner that was additionally supplied to each development housing 210 during printing of the 100 white paper sheets, was simultaneously measured.

The toner in the development housings 210 became weakly charged under the condition of the stress as described above. At this time, when highly charged toner was additionally supplied, occurrence of fogging was significant. In Table 2, edge portion fogging represents fogging that occurs when a rate of additionally supplied toner in the development housing 210 is relatively high although agitating is sufficient. Further, when heights of the downstream-side reduction wall 28A and the upstream-side reduction wall 28B are increased, the weight of toner in the development housing 210 is reduced, and vertical stripes appear in a halftone image. Therefore, this problem was simultaneously examined (vertical stripe in halftone image).

The criterion of evaluation for stripe fogging was the same as in Experiment 1. The evaluations for the vertical stripe in halftone image and the edge portion fogging were made in the following manners.

Vertical strip in halftone image: "Excellent": not greatly different from that of the conventional developing apparatus 20Z, "standard": slightly poorer than that of the conventional developing apparatus 20Z, and "poor": much poorer than that of the conventional developing apparatus 20Z Edge portion fogging was at Level 1 in the case of F.D≥0.010 being satisfied, at Level 2 in the case of 0.007≤F.D≤0.009 being satisfied, at Level 3 in the case of 0.004≤F.D≤0.006 being satisfied, and at Level 4 in the case of 0≤F.D≤0.003 being satisfied. (A maximum value obtained by measurement of 400 paper sheets was used as the F. D. The F. D value was measured by a reflection densitometer (TC-6DS manufactured by Tokyo Denshoku Co., Ltd.)

TABLE 2

| | NO | | | | | | |
|---|---|---|---|---|---|---|---|
| | (1) | (2) | (3) | (4) | (5) | (6) | (7) |
| Height H2 (mm) of upstream-side reduction wall 28B | 2 | 2 | 2 | 2 | 2 | 2 | 2 |
| Height H1 (mm) of downstream-side reduction wall 28A | 0.5 | 1 | 2 | 3 | 4 | 4.5 | 5 |
| Ratio (H1/H2) of height H1 for downstream side to height H2 for upstream side | 0.25 | 0.5 | 1 | 1.5 | 2 | 2.25 | 2.5 |
| Weight (g) of toner in development housing before exchange of containers | 59.2 | 58.5 | 57.8 | 56.9 | 56.2 | 55.8 | 54.2 |
| Weight (g) of toner in development housing after exchange of containers | 62.3 | 60.8 | 59.3 | 58.2 | 57.1 | 56.6 | 55.0 |
| Amount of toner (g) that entered | 3.1 | 2.3 | 1.5 | 1.3 | 0.9 | 0.8 | 0.8 |
| Vertical stripe in halftone image | Excellent | Excellent | Excellent | Excellent | Excellent | Standard | Poor |
| Stripe fogging | Good | Good | Excellent | Excellent | Excellent | Good | Good |
| Edge portion fogging | 1 | 2 | 3 | 3 | 4 | 4 | 4 |

Table 2 indicates a result that, particularly in the case of a ratio (H1/H2) of the height H1 of the downstream-side reduction wall 28A to the height H2 of the upstream-side reduction wall 28B ranging from 1.0 to 2.0 (NOS. 3 to 5 in Table 2), toner was stably distributed upstream and downstream of the toner supply inlet 25, and the vertical stripe in the halftone image, the stripe fogging, and the edge portion fogging were reduced. Further, it was confirmed that, in each example, an amount of toner that entered the development housing 210 when the new toner container 50 was mounted, was reduced as compared to in Comparative example 1 described above.

According to the first embodiment and the second embodiment, the downstream-side accumulation portion 27 in which toner is accumulated at a position that opposes the toner supply inlet 25 is formed due to the downstream-side reduction wall 28A or the reduction paddle 28C disposed downstream of the toner supply inlet 25 in the first direction. Further, the upstream-side accumulation portion 29 in which toner is accumulated upstream of the toner supply inlet 25 in the first direction is formed due to the upstream-side reduction wall 28B disposed upstream of the toner supply inlet 25 in the first direction. Therefore, even when an amount of toner in the development housing 210 is changed, a toner accumulation portion is stably formed downstream and upstream of the toner supply inlet 25. Accordingly, even when change of an amount of toner in the toner container 50 causes change of a pressure applied to the toner supply inlet 25 by additionally supplied toner, change of an amount of additional toner that enters the internal space 220 is reduced.

Further, according to the first embodiment and the second embodiment, the additional toner supplied through the toner supply inlet 25 is conveyed in the first direction so as to sink under the downstream-side reduction wall 28A. Therefore, the additionally supplied toner enters the second conveying path 222 in a state where the additionally supplied toner is sufficiently mixed with toner therearound. In other words, the additionally supplied toner is less likely to enter the second conveying path 222 while moving over an upper layer of the toner layer. Therefore, the additional toner is less likely to be supplied as a lump to the developing roller 21. Further, since the downstream-side reduction wall 28A and the upstream-side reduction wall 28B are provided downstream and upstream, respectively, of the toner supply inlet 25, so as to project, a large amount of toner is less likely to enter the development housing 210 from the toner container 50.

Further, according to the first embodiment and the second embodiment, the height of the downstream-side reduction wall 28A is set so as to be greater than or equal to the height of the upstream-side reduction wall 28B, but not greater than twice the height of the upstream-side reduction wall 28B. In this case, the additional toner supplied through the toner supply inlet 25 is conveyed to the lower portion of the toner layer, and the additional toner can be stably dispersed. Further, toner is stably distributed upstream and downstream of the toner supply inlet 25.

Further, in the image forming apparatus 1 including the developing apparatus 20 according to the first embodiment or the developing apparatus 20A according to the second embodiment, occurrence of developer fogging in an image formed on a sheet is advantageously reduced.

Next, a developing apparatus 20B according to a third embodiment of the present disclosure will be described with reference to FIGS. 10 to 14. Difference of the developing apparatus 20B of the present embodiment from the developing apparatus 20 according to the embodiment described above will be mainly described, and description of the structure common to the developing apparatus 20B and the developing apparatus 20 is not given.

The first agitating screw 23 of the developing apparatus 20B according to the third embodiment of the present disclosure is disposed in the first conveying path 221. The first agitating screw 23 includes the first rotation shaft 23*a* (rotation axis), and the first helical blades 23*b* (screw blades) that are helically disposed so as to project on the circumference of the first rotation shaft 23*a*. The first agitating screw 23 is driven to rotate about the first rotation shaft 23*a* (in the direction indicated by an arrow D33 in FIG. 10, the direction indicated by an arrow R2 in FIG. 11) by not-illustrated driving means, to convey toner in the direction (the first direction) indicated by an arrow D1 in FIG. 11. The first agitating screw 23 conveys developer such that the developer passes by a position where the toner supply inlet 25 opposes the first conveying path 221. Thus, the first agitating screw 23 functions to mix toner that is additionally supplied through the toner supply inlet 25, and toner being conveyed in the first conveying path 221, and deliver the mixed toner toward the second conveying path 222. In the present embodiment, the outer diameter of each first helical blade 23*b* is set as 14 mm, and a pitch, in the axial direction, for the first helical blades 23*b* is set as 20 mm. The pitch may be determined according to a conveying performance of the first agitating screw 23. However, the lower limit of the pitch is preferably 15 mm in order to maintain the toner conveying capability. The first paddle 23*c* is disposed on the downstream side, in the toner conveying direction (the direction indicated by the arrow D1), of the first agitating screw 23. The first paddle 23*c* is a plate-like member disposed on the first rotation shaft 23*a*. The first paddle 23*c* rotates with the first rotation shaft 23*a*, and delivers toner from the first conveying path 221 to the second conveying path 222 in the direction indicated by an arrow D3 in FIG. 11. In the present embodiment, the length, in the axial direction, of the first paddle 23*c* is set as 20 mm. Further, the first agitating screw 23 includes a conveying capability reduction shaft portion 26C (elimination portion) instead of the first shaft portion 26A and the second shaft portion 26B. In the conveying capability reduction shaft portion 26C, the first helical blades 23*b* are locally eliminated, and only the first rotation shaft 23*a* is provided. A conveying capability reduction wall 28D described below is disposed so as to oppose the conveying capability reduction shaft portion 26C.

In the first agitating screw 23, the conveying capability reduction shaft portion 26C described above is disposed downstream of the toner supply inlet 25 in the toner conveying direction. The conveying capability reduction shaft portion 26C is formed by eliminating the first helical blades 23*b* of the first agitating screw 23 (see FIG. 14). In the present embodiment, the length, in the axial direction, of the conveying capability reduction shaft portion 26C is set as 12 mm. In other words, the conveying capability reduction shaft portion 26C corresponds to a portion locally formed by only the first rotation shaft 23*a*. In this case, the conveying capability reduction shaft portion 26C does not have a function of conveying developer in the axial direction of the first rotation shaft 23*a*.

Further, the developing apparatus 20B includes the conveying capability reduction wall 28D. The conveying capability reduction wall 28D is a wall portion that is disposed downstream of the toner supply inlet 25 in the first direction (the direction indicated by the arrow D1) so as to project downward from the top cover 211 of the development housing 210. The conveying capability reduction wall 28D locally reduces toner conveying capability of the first agitating screw 23, thereby forming an accumulation portion 27B in which toner is accumulated at a position that opposes the toner supply inlet 25. The conveying capability reduction wall 28D is disposed such that the lower end of the conveying capability reduction wall 28D is closer to the first rotation shaft 23*a* than the outer diameter end of the first helical blades 23*b* of the first agitating screw 23 is. As described above, the conveying capability reduction shaft portion 26C is disposed so as to oppose the conveying capability reduction wall 28D, thereby preventing the first agitating screw 23 and the conveying capability reduction wall 28D from interfering with each other.

In the first conveying path 221, toner conveyed from a region upstream of the conveying capability reduction wall 28D hits against the conveying capability reduction wall 28D, and starts to be accumulated. Toner is accumulated at a position, immediately upstream of the conveying capability reduction wall 28D, at which the toner supply inlet 25 opposes the first conveying path 221, and in a region preceding the position. As a result, the accumulation portion 27B for toner is formed near the entrance of the toner supply inlet 25.

When an amount of toner in the internal space 220 is increased due to the additional toner T2 being supplied through the toner supply inlet 25, the toner supply inlet 25 is blocked (sealed) with toner accumulated in the accumulation portion 27B, to reduce additional supply of toner. Thereafter, when toner in the internal space 220 is consumed by the developing roller 21, and toner accumulated in the accumulation portion 27B is reduced, toner with which the toner supply inlet 25 is blocked is reduced, whereby a gap is generated between the accumulation portion 27B and the toner supply inlet 25. As a result, the additional toner T2 enters the internal space 220 again through the toner supply inlet 25. Thus, in the present embodiment, a volume-based toner supply mode is used in which a received amount of toner to be additionally supplied, is adjusted according to reduction of toner accumulated in the accumulation portion 27B.

Figure 15:
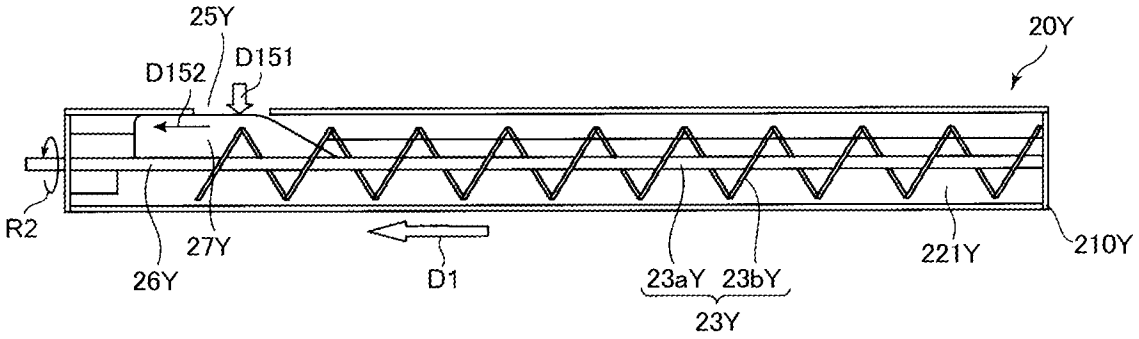
FIG. 15 is a cross-sectional view illustrating a flow of developer in a conventional developing apparatus.

Next, a problem with supply of toner by a developing apparatus 20Y as compared to supply of toner in the present embodiment will be described. FIG. 15 is a cross-sectional view of the developing apparatus 20Y. FIG. 15 shows a first conveying path 221Y as viewed from the side thereof. The developing apparatus 20Y also includes a conveying capability reduction portion 26Y in which helical blades are locally eliminated, as in the developing apparatus 20B of the present embodiment. The conveying capability reduction portion 26Y does not have a conveying capability in the axial direction, whereby an accumulation portion 27Y is formed in a region opposing a toner supply inlet 25Y. Toner is additionally supplied from a not-illustrated toner container to the toner supply inlet 25Y according to an amount of toner in the accumulation portion 27Y (an arrow D151).

In the developing apparatus 20Y having the volume-based toner supply mode as described above, when toner remaining in the toner container is reduced, an amount of supplied toner is reduced, thereby reducing an amount of toner in a development housing 210Y. In this case, when it is determined, by a not-illustrated density sensor, that an amount of remaining toner is small, exchange of the toner containers is prompted. At this time, since an amount of toner in the development housing 210Y is small, an amount of toner in the accumulation portion 27Y is also small. Additional toner enters the development housing 210Y from a new toner container mounted, by a user, to the developing apparatus 20Y. The new toner container is filled with a large amount of toner, and therefore the additional toner is likely to rapidly enter the development housing 210Y.

Toner that has entered the development housing 210Y enters the accumulation portion 27Y. The toner is conveyed to a second conveying path 222Y (not shown) that communicates with a first conveying path 221Y, according to a first agitating screw 23Y being driven to rotate. At this time, a surface state or an electrically charged state may be different between a large amount of additional toner that has been supplied to the development housing 210Y from the new toner container, and existing toner having been circulated in the development housing 210Y, in many cases. Although the additional toner and the existing toner are circulated in the development housing 210Y, to gradually have approximate characteristics, the toner may be charged so as to be polarized into two poles, due to difference in surface state between the additional toner and the existing toner, immediately after the entering of the additional toner. Namely, one of the additional toner and the existing toner is positively charged, and the other thereof is negatively charged. As a result, developer fogging may occur in an image on the photosensitive drum 31 and on a sheet.

In addition, additionally supplied toner, which rapidly enters the development housing 210Y, is less likely to sink toward the bottom portion of the development housing 210Y even if a rotational force of the first agitating screw 23Y is applied. In particular, in the conveying capability reduction portion 26Y located downstream of the toner supply inlet 25Y, toner agitating capability is reduced, so that toner dispersion becomes more difficult. In this case, the additional toner that has entered the development housing 210Y, enters the second conveying path 222Y through a first communication path 223Y (not shown) while moving over the surface layer (the upper layer, a draft surface portion) of the toner layer in the first conveying path 221Y (an arrow D152). If toner that has entered the second conveying path 222Y without sufficiently dispersing, is supplied as a lump to a developing roller 21Y (not shown) as it is, a problem arises that vertically-striped developer fogging occurs in an image.

<Conveying Capability Reduction Wall 28D>

Figure 11:
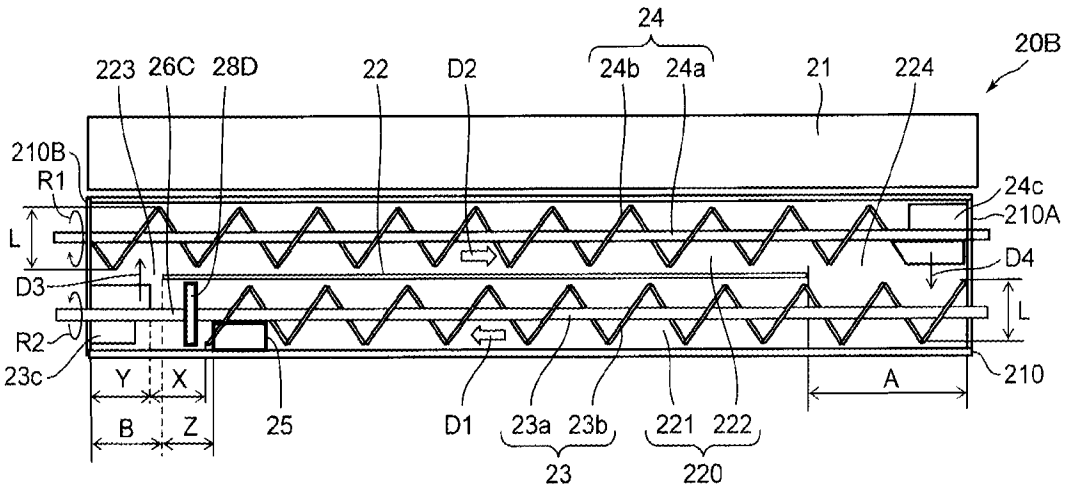
FIG. 11 is a plan view of the developing apparatus according to the third embodiment of the present disclosure.
Figure 12:
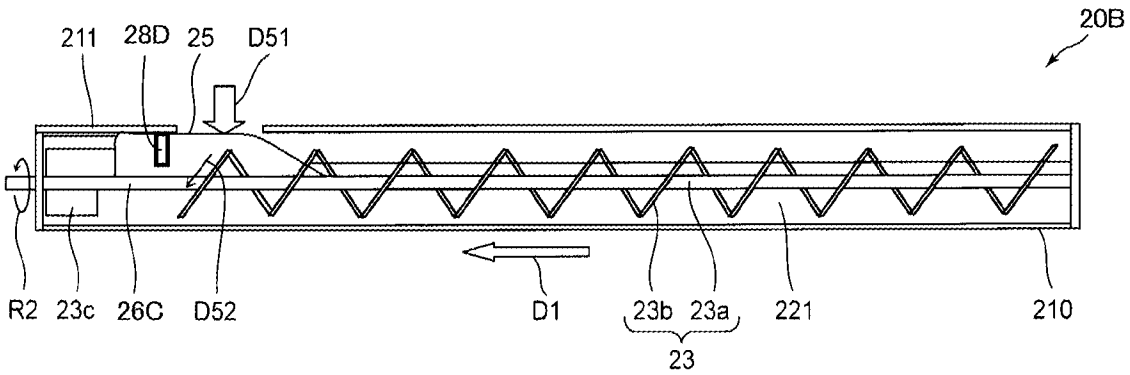
FIG. 12 is a cross-sectional view of the developing apparatus, as viewed from the front thereof, according to the third embodiment of the present disclosure.
Figure 13:
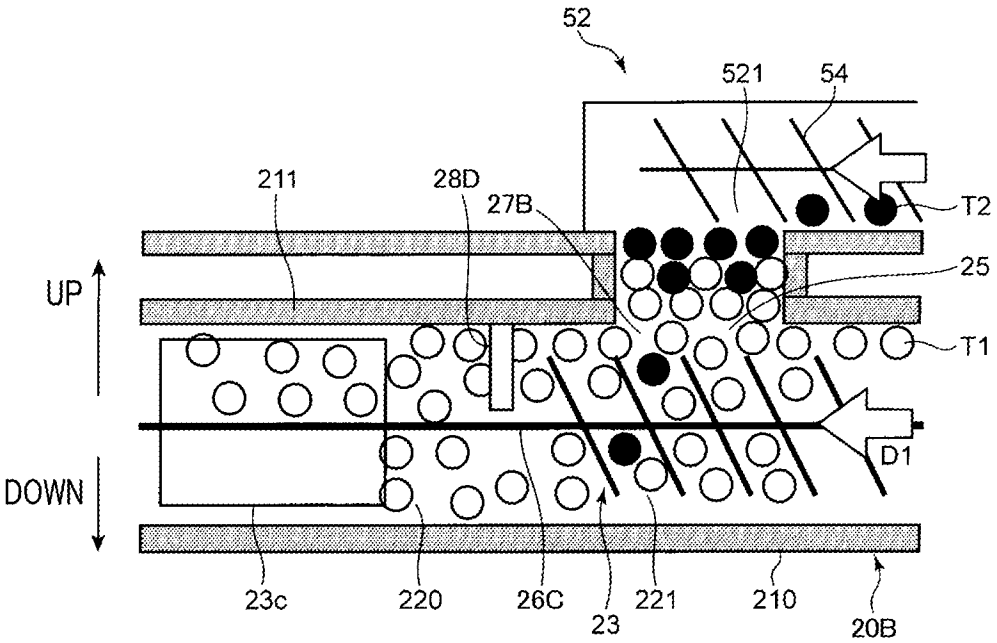
FIG. 13 is a schematic diagram illustrating a state where toner is supplied, in the developing apparatus according to the third embodiment of the present disclosure.
Figure 14:
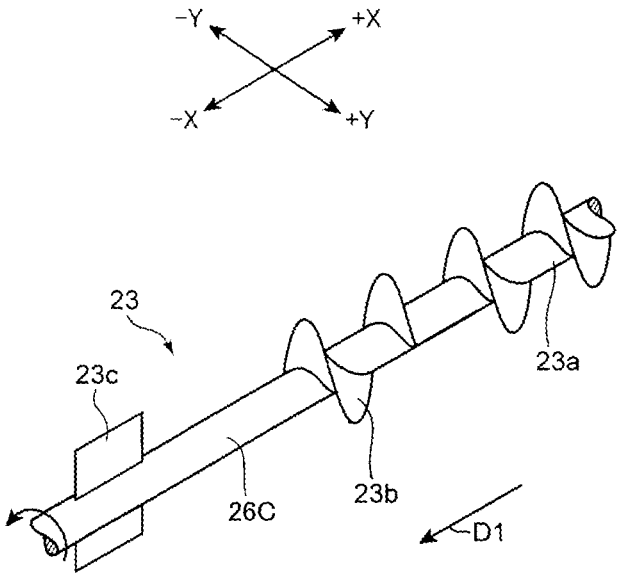
FIG. 14 is an enlarged perspective view of a first agitating screw of the developing apparatus according to the third embodiment of the present disclosure.

The developing apparatus 20B according to the present embodiment includes the conveying capability reduction wall 28D described above. As shown in FIGS. 11 and 12, the conveying capability reduction wall 28D is a wall portion that projects downward from the top cover 211 so as to have a predetermined height in the downward direction. Further, the conveying capability reduction wall 28D is a wall portion that is disposed above the first agitating screw 23 so as to have a predetermined width in a direction (front-rear direction, a direction orthogonal to the first rotation shaft 23*a*) from the first agitating screw 23 toward the developing roller 21.

In the present embodiment, as indicated by an arrow D52 in FIG. 12, additional toner supplied through the toner supply inlet 25 is conveyed so as to sink under the conveying capability reduction wall 28D due to a rotational force of the first agitating screw 23. Therefore, the additional toner is appropriately mixed with toner therearound. In other words, additional toner is less likely to be supplied to the second conveying path 222 and the developing roller 21 in an insufficiently dispersed state while sliding over the upper layer (draft surface) of the toner layer in a region downstream of the toner supply inlet 25. Further, the conveying capability reduction wall 28D is disposed such that the lower end of the conveying capability reduction wall 28D is closer to the first rotation shaft 23*a* than the outer diameter end of the first helical blades 23*b* of the first agitating screw 23 is. Therefore, the accumulation portion 27B is stably formed below the toner supply inlet 25. Further, additional toner supplied through the toner supply inlet 25 is conveyed so as to sink into a lower portion with an enhanced effectiveness. Further, in the present embodiment, the conveying capability reduction wall 28D is a plate-like member that extends in a direction orthogonal to the first rotation shaft 23*a* of the first agitating screw 23, and the lower end of the conveying capability reduction wall 28D horizontally extends. The lower end of the conveying capability reduction wall 28D is positioned lower than the upper ends of the first helical blades 23*b* that rotate, by a distance that is longer than or equal to 1.5 mm, and not longer than 2.0 mm. As a result, the additionally supplied toner is advantageously prevented from sliding over the upper layer of the tone layer.

Figure 16:
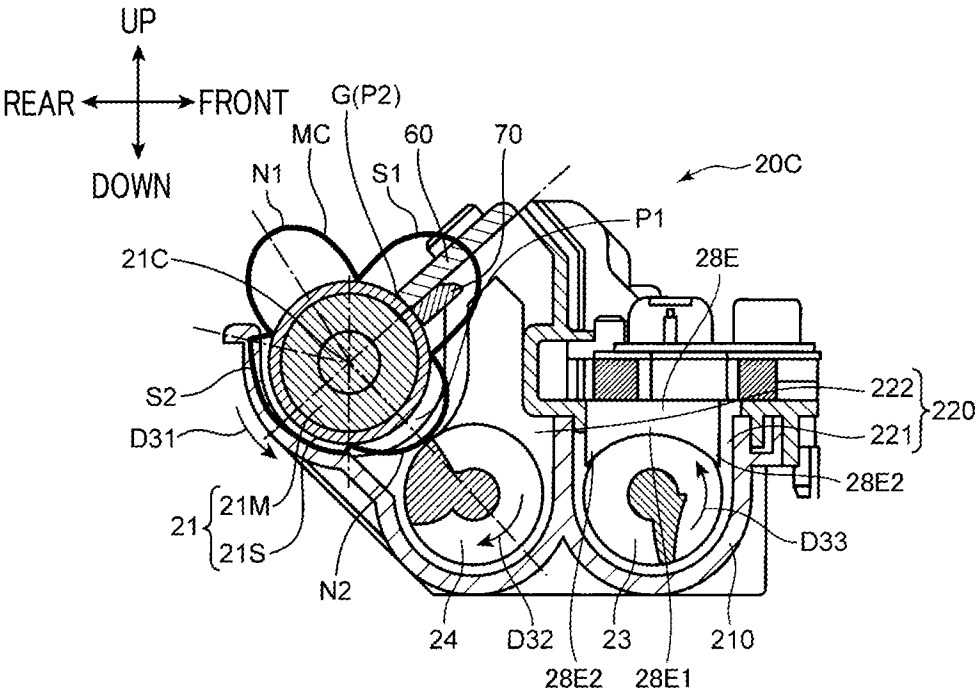
FIG. 16 is a cross-sectional view of a developing apparatus, as viewed from the side thereof, according to a fourth embodiment of the present disclosure.

Next, a developing apparatus 20C according to a fourth embodiment of the present disclosure will be described. FIG. 16 is a side sectional view of an internal structure of the developing apparatus 20C. The developing apparatus 20C of the present embodiment is different from the developing apparatus 20B of the embodiment described above in that the developing apparatus 20C includes a conveying capability reduction wall 28E instead of the conveying capability reduction wall 28D of the developing apparatus 20B. Therefore, the difference will be mainly described and description common to both of the embodiments is not given.

Similarly to the conveying capability reduction wall 28D, the conveying capability reduction wall 28E is a plate-like member that extends in a direction orthogonal to the first rotation shaft 23*a*, and is a wall portion that is disposed downstream of the toner supply inlet 25 in the first direction so as to project downward from the top cover 211 of the development housing 210. The conveying capability reduction wall 28E locally reduces toner conveying capability of the first agitating screw 23, thereby forming an accumulation portion 27B in which toner is accumulated at a position that opposes the toner supply inlet 25 (see FIG. 13). As shown in FIG. 16, the conveying capability reduction wall 28E has an arch-shaped lower edge that opposes the first agitating screw 23. In other words, in a case where a cross-section orthogonal to the first rotation shaft 23*a* is viewed, when H1 represents a height, in the downward projecting direction, of a center portion 28E1 of the conveying capability reduction wall 28E from the top cover 211, and H2 represents a height, in the downward projecting direction, of an end portion 28E2 of the conveying capability reduction wall 28E from the top cover 211, a relationship of H1<H2 is satisfied.

Also in the developing apparatus 20C that includes the conveying capability reduction wall 28E having such a structure, additionally supplied toner is advantageously prevented from sliding over the upper layer of the tone layer. Further, since the end portion 28E2 of the conveying capability reduction wall 28E extends so as to be lower than the center portion 28E1, additionally supplied toner that is moved outward of outer circumferential edges of the first helical blades 23*b* due to a rotational force of the first agitating screw 23 hits against an end portion 28E2, and can be conveyed downward of the end portion 28E2. Therefore, the additionally supplied toner is less likely to move up to the upper layer of the toner layer in a state where the additionally supplied toner is not sufficiently dispersed.

Figure 17A:
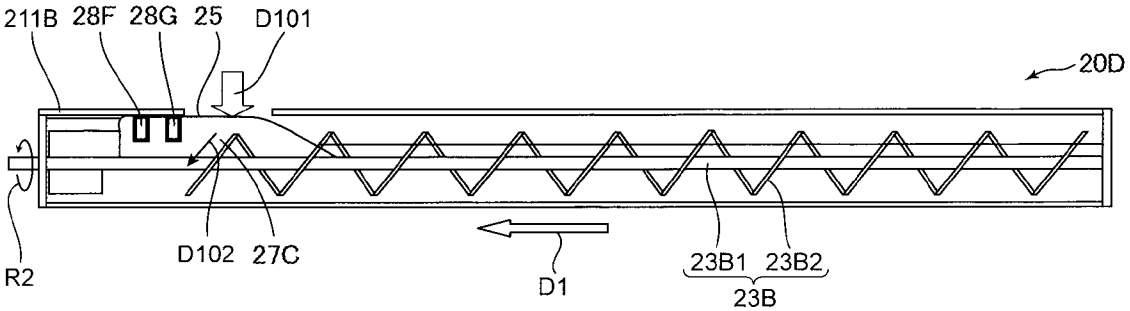
FIG. 17A is a cross-sectional view of a developing apparatus, as viewed from the front thereof, according to a fifth embodiment of the present disclosure.
Figure 17B:
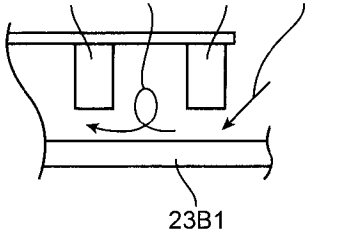
FIG. 17B is an enlarged view of a cross-section of the developing apparatus, as viewed from the front thereof, according to the fifth embodiment of the present disclosure.

Next, a developing apparatus 20D according to a fifth embodiment of the present disclosure will be described. FIG. 17A is a cross-sectional view of an internal structure of the developing apparatus 20D as viewed from the front thereof. Further, FIG. 17B is a partially enlarged cross-sectional view of the developing apparatus 20D. The developing apparatus 20D of the present embodiment is different from the developing apparatus 20B of the embodiment described above in that the developing apparatus 20D includes a conveying capability reduction wall 28F and a conveying capability reduction wall 28G, instead of the conveying capability reduction wall 28D of the developing apparatus 20B. Therefore, the difference will be mainly described and description common to both of the embodiments is not given.

The conveying capability reduction wall 28F and the conveying capability reduction wall 28G are disposed downstream of the toner supply inlet 25 in the first direction (the direction indicated by an arrow D1), so as to be spaced from each other in the first direction. Similarly to the conveying capability reduction wall 28D described above, each of the conveying capability reduction wall 28F and the conveying capability reduction wall 28G is a plate-like member that extends in a direction orthogonal to a first rotation shaft 23B1, and is a wall portion that projects downward from a top cover 211B of the development housing 210. The conveying capability reduction wall 28F and the conveying capability reduction wall 28G locally reduce toner conveying capability of the first agitating screw 23B, thereby forming an accumulation portion 27C in which toner is accumulated at a position that opposes the toner supply inlet 25.

Also in the developing apparatus 20D that includes the conveying capability reduction wall 28F and the conveying capability reduction wall 28G having such a structure, additionally supplied toner is advantageously prevented from sliding over the upper layer of the tone layer. Further, as indicated by an arrow D103 in FIG. 17B, turbulent flow of toner occurs between the adjacent conveying capability reduction walls, thereby dispersing additionally supplied toner in the toner therearound, with an enhanced effectiveness.

In a case where, in the plurality of conveying capability reduction walls, H3 represents a height, in the downward projecting direction, of the conveying capability reduction wall 28F (first reduction wall) disposed on the downstream side in the first direction, from the top cover 211B, and H4 represents a height, in the downward projecting direction, of the conveying capability reduction wall 28G (second reduction wall) disposed on the upstream side in the first direction, from the top cover 211B, a relationship of H3>H4 is preferably satisfied. In this case, turbulent flow of toner is likely to occur, and additionally supplied toner is conveyed so as to gradually sink downward, thereby dispersing additionally supplied toner with an enhanced effectiveness.

Figure 18:
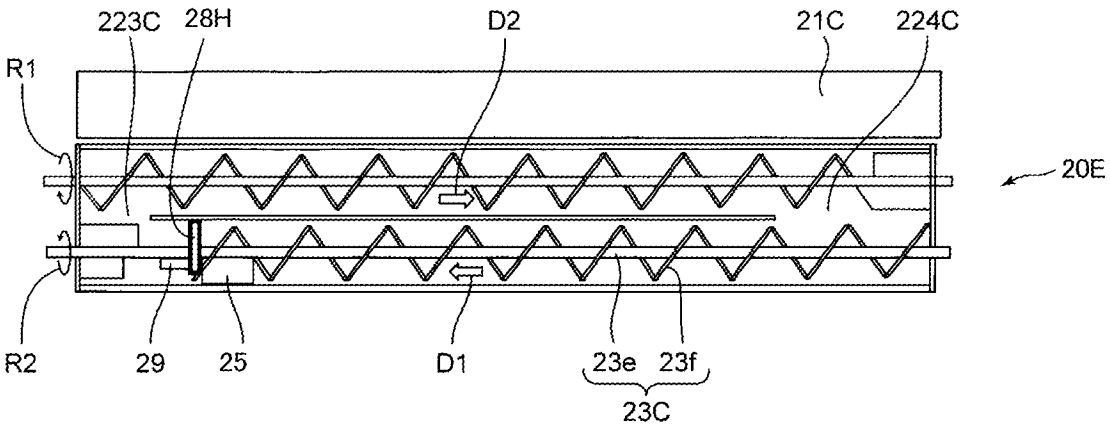
FIG. 18 is a plan view of a developing apparatus according to a sixth embodiment of the present disclosure.
Figure 19:
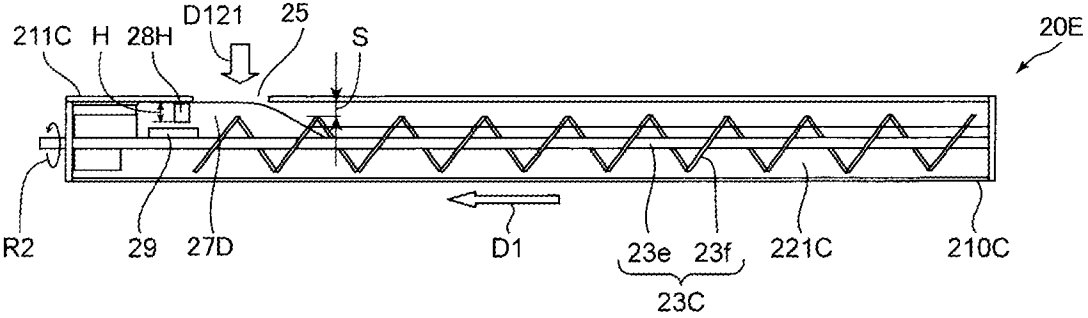
FIG. 19 is a cross-sectional view of the developing apparatus, as viewed from the front thereof, according to the sixth embodiment of the present disclosure.
Figure 20:
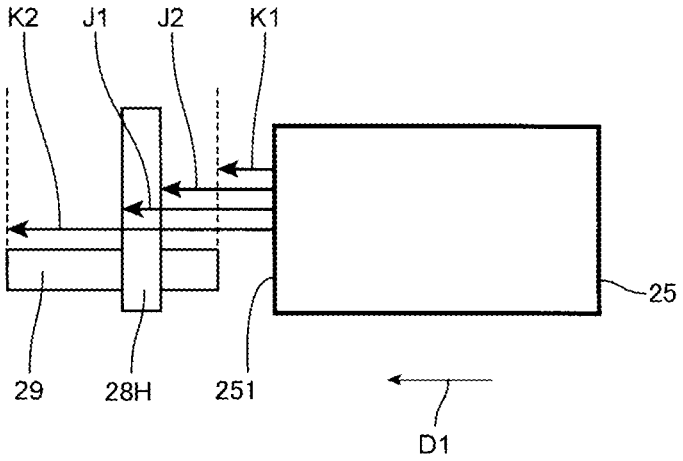
FIG. 20 illustrates a positional relationship between a conveying capability reduction wall and a reduction paddle.

Next, a developing apparatus 20E according to a sixth embodiment of the present disclosure will be described with reference to FIGS. 18 to 20. The developing apparatus 20E of the present embodiment is different from the developing apparatus 20B of the embodiment described above in that the developing apparatus 20E includes a reduction paddle (agitating paddle) 29 in addition to a conveying capability reduction wall 28H corresponding to the conveying capability reduction wall 28D of the developing apparatus 20B. Therefore, the difference will be mainly described and description common to both of the embodiments is not given. FIG. 18 is a plan view of an internal structure of the developing apparatus 20E. FIG. 19 is a cross-sectional view of the internal structure of the developing apparatus 20E as viewed from the front thereof. FIG. 20 is a schematic diagram illustrating a positional relationship between the conveying capability reduction wall 28H and the reduction paddle 29.

Similarly to the conveying capability reduction wall 28D described above, the conveying capability reduction wall 28H is a wall portion that is disposed downstream of the toner supply inlet 25 in the first direction (the direction indicated by an arrow D1) so as to project downward from a top cover 211C of a development housing 210C. Further, the conveying capability reduction wall 28H is a plate-like member that extends in a direction orthogonal to a first rotation shaft 23*e*. The conveying capability reduction wall 28H locally reduces toner conveying capability of a first agitating screw 23C, thereby forming an accumulation portion 27D in which toner is accumulated at a position that opposes the toner supply inlet 25. The conveying capability reduction wall 28H is disposed such that the lower end of the conveying capability reduction wall 28H is closer to the first rotation shaft 23*e* than the outer circumferential edge of first helical blades 23*f* of the first agitating screw 23C is.

The reduction paddle 29 projects from the first rotation shaft 23*e* in the radial direction so as to oppose the conveying capability reduction wall 28H. The reduction paddle 29 passes below the conveying capability reduction wall 28H according to the rotation of the first agitating screw 23C. Additional toner supplied through the toner supply inlet 25 is conveyed downward of the conveying capability reduction wall 28H, and mixed with toner therearound by the reduction paddle 29.

As shown in FIG. 20, in the present embodiment, K1 represents a distance from an end portion 251 of the toner supply inlet 25 on the downstream side in the first direction, to an end portion of the reduction paddle 29 on the upstream side in the first direction, and K2 represents a distance from the end portion 251 to an end portion of the reduction paddle 29 on the downstream side in the first direction. Further, J2 represents a distance from the end portion 251 of the toner supply inlet 25 on the downstream side in the first direction, to an end portion of the conveying capability reduction wall 28H on the upstream side in the first direction, and J1 represents a distance from the end portion 251 to an end portion of the conveying capability reduction wall 28H on the downstream side in the first direction. In this case, as shown in FIG. 20, a relationship of K1<J2<J1<K2 is preferably satisfied. In other words, the end portion of the reduction paddle 29 on the upstream side in the first direction is preferably positioned downward of the toner supply inlet 25 in the first direction, and upstream of the conveying capability reduction wall 28H in the first direction. Further, the end portion of the reduction paddle 29 on the downstream side in the first direction is preferably positioned downstream of the conveying capability reduction wall 28H in the first direction. In this case, the reduction paddle 29 functions to accumulate toner in the accumulation portion 27D in a region upstream of the conveying capability reduction wall 28H. Further, the reduction paddle 29 functions to disperse toner in the circumferential direction and the radial direction in a region downstream of the conveying capability reduction wall 28H. Therefore, regulation of an amount of additionally supplied toner and dispersion of additionally supplied toner can be stably executed.

EXAMPLES

Next, examples for the third to the sixth embodiments of the present disclosure will be described. However, the present disclosure is not restricted by examples described below. Examples described below were implemented under the following common experimental conditions.

Common Experimental Conditions

Photosensitive drum 31: OPC drum

Circumferential speed of photosensitive drum 31: 146 mm/sec

Layer regulation gap G: 0.3 mm

Developing bias AC component: rectangular wave having amplitude of 1.7 kV, and duty ratio of 50%

Developing bias DC component: 270V

Surface potential of photosensitive drum 31 (background portion/image portion): 430V/30V Diameter of developing roller 21: 16 mm Diameter of photosensitive drum 31: 24 mm Average particle diameter of magnetic toner: 6.8 μm (D50)

Shape of each of first agitating screw 23 and second agitating screw 24: Outer diameter of 14 mm, screw pitch of 20 mm The number of rotations of each of first agitating screw 23 and second agitating screw 24: 50 rpm Length X, in axial direction, of conveying capability reduction shaft portion 26C: 12 mm Opening width B, in axial direction, of first communication path 223: 20 mm Opening width A, in axial direction, of second communication path 224: 40 mm Opening shape of toner supply inlet 25: 14×8 mm Minimum distance Z, in axial direction, between toner supply inlet 25 and first communication path 223: 10 mm Minimum distance, in axial direction, between toner supply inlet 25 and second communication path 224: 140 mm

Experiment 3

Firstly, a new toner container 50 was mounted to the image forming apparatus 1, and an image was continuously printed with the coverage rate being 3.8% until toner was consumed and the toner container 50 became empty. In this state, a new toner container 50 the weight of which was previously obtained was further mounted to the image forming apparatus 1. Printing of 100 white paper sheets was performed, and thereafter supply fogging and stripe fogging were evaluated. The supply fogging represents a phenomenon in which toner fogging occurs over the entirety of a surface of a paper sheet due to electrical charging being not stable between additional toner supplied from the toner container 50 and toner being circulated in the development housing 210. The stripe fogging represents fogging that occurs when additionally supplied toner slides over a toner layer, and is supplied to the developing roller 21 in a condensed state.

Figure 10:
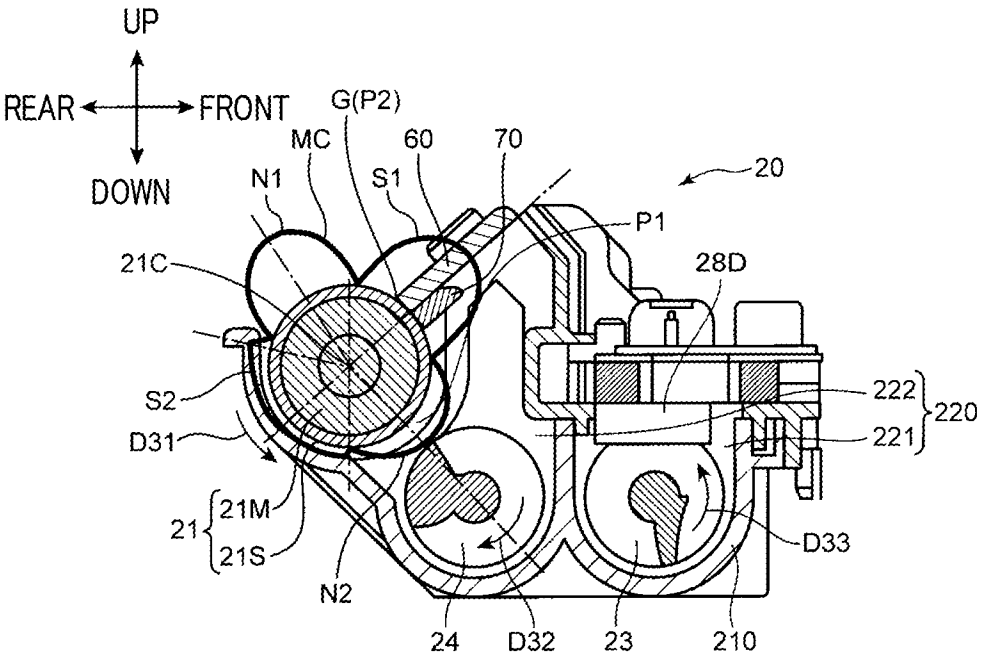
FIG. 10 is a cross-sectional view of a developing apparatus, as viewed from the side thereof, according to a third embodiment of the present disclosure.

As wall types in the following experiments, a wall type A represents the conveying capability reduction wall 28D shown in FIG. 10, and a wall type B represents the conveying capability reduction wall 28E shown in FIG. 16. The height H, in the downward projecting direction, of each conveying capability reduction wall from the top cover 211 was changed, and the supply fogging and the stripe fogging as described above were evaluated. The evaluations for the supply fogging and the stripe fogging were made by using a background portion of a sheet. In the below description, a level of each of the supply fogging and the stripe fogging is defined such that "excellent" represents a state where no fogging occurred, "standard" represents a state where fogging slightly occurred but there was no problem in actual use, and "poor" represents a state where fogging occurred.

Table 3 indicates results for supply fogging and stripe fogging. An overlap represents a portion in which each conveying capability reduction wall and the first helical blade 23*b* of the first agitating screw 23 are positioned so as to overlap each other in the vertical direction (corresponds to H−S in FIG. 19, S=1.0 mm). As indicated in Table 3, in Examples 3 to 9 in which the conveying capability reduction wall 28D or the conveying capability reduction wall 28E was provided, the results for both the supply fogging and the stripe fogging were better than the results in Comparative example 2. Further, particularly when the overlap was greater than or equal to 1.5 mm, and not greater than 2.0 mm in the wall type A (Examples 5 and 6), the results for both the supply fogging and the stripe fogging were good. Similarly, in the wall type B (Example 7), when the height, in the projecting direction, of each end portion of the conveying capability reduction wall 28E from the top cover 211 was greater than the height, in the projecting direction, of the center portion of the conveying capability reduction wall 28E from the top cover 211, the results for both the supply fogging and the stripe fogging were good.

TABLE 3

| | Wall type | Wall height H | Overlap | Supply fogging | Stripe fogging |
|---|---|---|---|---|---|
| Example 3 | A | 1.5 mm | 0.5 mm | Standard | Excellent |
| Example 4 | A | 2 mm | 1 mm | Standard | Excellent |
| Example 5 | A | 2.5 mm | 1.5 mm | Excellent | Excellent |
| Example 6 | A | 3 mm | 2 mm | Excellent | Excellent |
| Example 7 | B | Center portion: 1.5 mm, each end portion: 3 mm | — | Excellent | Excellent |
| Example 8 | A | 3.5 mm | 2.5 mm | Excellent | Standard |
| Example 9 | A | 1 mm | 0 mm | Standard | Excellent |
| Comparative example 2 | Not provided | — | — | Poor | Standard |

Experiment 4

Next, in the developing apparatus 20D shown in FIGS. 17A and 17B, the height (wall height), in the projection direction, of each of the conveying capability reduction wall 28F and the conveying capability reduction wall 28G was changed, and the supply fogging and the stripe fogging were evaluated. In each of Examples 10 to 15, a wall (wall type A) having the same shape as the conveying capability reduction wall 28D having the horizontal lower end was used. Further, a distance S between the top cover 211 and the outer circumferential edge of the first helical blade 23*b* of the first agitating screw 23 was 1 mm. The result of Experiment 4 is indicated in Table 4.

TABLE 4

| | Wall height (upstream side) | Wall height (downstream side) | Supply fogging | Stripe fogging |
|---|---|---|---|---|
| Example 10 | 1 mm | 1 mm | Standard | Excellent |
| Example 11 | 1.5 mm | 1.5 mm | Standard | Excellent |
| Example 12 | 2 mm | 2 mm | Excellent | Excellent |
| Example 13 | 1 mm | 1.5 mm | Excellent | Excellent |
| Example 14 | 1 mm | 2 mm | Excellent | Excellent |
| Example 15 | 1.5 mm | 2 mm | Excellent | Excellent |

As indicated in Table 4, particularly when the wall height of the conveying capability reduction wall 28F was greater than the wall height of the conveying capability reduction wall 28G (Examples 13 to 15), the results for the supply fogging and the stripe fogging were good. In Example 12, since 1 mm was assuredly obtained for the overlap of each conveying capability reduction wall with the first agitating screw 23B from the outer circumferential edge of the first agitating screw 23B, even when the wall height of the conveying capability reduction wall 28F and the wall height of the conveying capability reduction wall 28G were equal to each other, the results for the supply fogging and the stripe fogging were good.

Experiment 5

Next, in the developing apparatus 20E shown in FIGS. 18 and 19, a relationship between the height H, in the projecting direction, of the conveying capability reduction wall 28H, and a distance S between the top cover 211C and the first helical blade 23*f* was changed, and an amount of additionally supplied toner and the stripe fogging were evaluated. The wall type of the conveying capability reduction wall 28H was the same as that of the conveying capability reduction wall 28D having the horizontal lower end (that is, the wall type A was used). For experiment, toner to be used was left as it was for three days in the environment where the temperature was 28° C. and the humidity was 80%, and the toner was further left as it was for one day in the environment where the temperature was 24.5° C. and the humidity was 50%. Thereafter, 55 g of the toner was supplied into the developing apparatus 20E. Agitating was performed for one minute. Thereafter, while toner that had been stored in the environment where the temperature was 24.5° C. and the humidity was 50% was being additionally supplied from the toner container 50, printing of 100 white paper sheets was performed and an image was printed on 300 paper sheets with the coverage rate being 3.8%, and an F. D (fogging density) was measured. The F. D was measured by a reflection densitometer (TC-6DS manufactured by Tokyo Denshoku Co., Ltd.). Further, as an amount of additionally supplied toner, an amount of toner that was additionally supplied into the developing apparatus 20E during the printing of the 100 white paper sheets, was measured. When distribution of toner in the developing apparatus 20E is stable, rapid supply of toner from the toner container 50 is prevented, thereby relatively reducing an amount of additionally supplied toner. The result of Experiment 5 is indicated in Table 5.

TABLE 5

| | S < H | S = H | S > H |
|---|---|---|---|
| S (mm) | 1 | 1 | 1 |
| H (mm) | 2 | 1 | 0.5 |
| Agitating paddle | Provided | Provided | Provided |

TABLE 5-continued

| | S < H | S = H | S > H |
|---|---|---|---|
| Stripe fogging | Did not occur | Occurred | Occurred |
| Amount of additionally supplied toner (g) | 0.8 | 1.2 | 2.5 |

As indicated in Table 5, when S<H was satisfied, i.e., when the conveying capability reduction wall 28H was disposed such that the lower end of the conveying capability reduction wall 28H was closer to the first rotation shaft 23*e* than the outer end of the first helical blade 23*f* was, it was confirmed that stripe fogging did not occur at all, and an amount of additionally supplied toner was particularly reduced. The criterion of evaluation for the stripe fogging was the same as that for Experiment 1.

Experiment 6

Next, for the developing apparatus 20E shown in FIGS. 18 and 19, evaluation for use of the conveying capability reduction wall 28H and the reduction paddle 29 in combination was made. For the developing apparatus 20E, a case where the conveying capability reduction wall 28H was provided or a case where the conveying capability reduction wall 28H was not provided, was combined with a case where the reduction paddle 29 was provided or a case where the reduction paddle 29 was not provided, for evaluation. At this time, edge portion fogging, in addition to the stripe fogging and an amount of additionally supplied toner, was evaluated. The edge portion fogging represents fogging that occurs when a rate of additionally supplied toner in the development housing 210 is relatively high although agitating is sufficient. In Experiment 6, the distance S satisfying S=1 mm, and the conveying capability reduction wall 28H satisfying H=2 mm was used. In the environment where the temperature was 24.5° C. and the humidity was 50%, the developing apparatus 20E for each condition was prepared and toner was charged into the developing apparatus 20E, and thereafter durable printing in which an image was printed on 2000 paper sheets with the coverage rate being 3.8% was performed, thereby applying stress to the toner. Next, the developing apparatus 20E for each condition was left as it was for 60 hours in the environment where the temperature was 28° C. and the humidity was 80%, thereby enhancing degradation of the toner. Finally, the developing apparatus 20E, for each condition, which had been left as it was, was left as it was for one hour in the environment where the temperature was 24.5° C. and the humidity was 50%. Thereafter, while toner that had been stored in the environment where the temperature was 24.5° C. and the humidity was 50% was being additionally supplied, printing of 100 white paper sheets was performed and an image was printed on 300 paper sheets with the coverage rate being 3.8%, and an F. D (fogging density) was measured. Further, as an amount of additionally supplied toner, an amount of toner that was additionally supplied into the developing apparatus 20E during the printing of the 100 white paper sheets was simultaneously confirmed.

The criterion of evaluation for stripe fogging was the same as that for Experiment 1. The evaluation for edge portion fogging was made in the following manner. Edge portion fogging was at Level 1 in the case of F.D≥0.010 being satisfied, at Level 2 in the case of 0.005≤F.D≤0.009 being satisfied, and at Level 3 in the case of 0≤F.D≤0.004 being satisfied.

A maximum value obtained by measurement of 400 paper sheets for an image was used as the F. D value. The F. D value was measured by a reflection densitometer (TC-6DS manufactured by Tokyo Denshoku Co., Ltd.). The result of Experiment 6 is indicated in Table 6.

TABLE 6

| | 1 | 2 | 3 | 4 |
|---|---|---|---|---|
| Conveying capability reduction wall | Not provided | Not provided | Provided | Provided |
| Agitating paddle | Not provided | Provided | Not provided | Provided |
| Stripe fogging | Occurred | Occurred | Slightly occurred | Did not occur |
| Edge portion fogging | 1 | 2 | 1 | 3 |
| Amount of additionally supplied toner (g) | 4.3 | 1.4 | 2.3 | 0.8 |

As indicated in Table 6, when the conveying capability reduction wall 28H and the reduction paddle 29 were used in combination, results for the stripe fogging and the edge portion fogging were particularly good. Further, it was confirmed that an amount of additionally supplied toner was the lowest, and an excessive amount of additional toner was prevented from entering the development housing 210.

Experiment 7

Next, for the developing apparatus 20E shown in FIGS. 18 and 19, evaluation for a minimum distance between the conveying capability reduction wall 28H and the reduction paddle 29 was made. A distance, in the projecting direction, of the reduction paddle 29 from the rotation shaft was changed, whereby the minimum distance ranges from 0.3 mm to 2.5 mm. For experiment, the developing apparatus 20E for each condition was prepared, and toner was charged into the developing apparatus 20E, and thereafter durable printing in which an image was printed on 2000 paper sheets with the coverage rate being 3.8% was performed, thereby applying stress to the toner. Next, the developing apparatus 20E for each condition was left as it was for 60 hours in the environment where the temperature was 28° C. and the humidity was 80%, thereby enhancing degradation of the toner. Finally, the developing apparatus 20E, for each condition, which had been left as it was, was left as it was for one hour in the environment where the temperature was 24.5° C. and the humidity was 50%. Thereafter, while toner that had been stored in the environment where the temperature was 24.5° C. and the humidity was 50% was being additionally supplied, printing of 100 white paper sheets was performed, and it was confirmed whether or not stripe fogging occurred. An amount of toner additionally supplied into the developing apparatus 20E was simultaneously confirmed. Further, whether or not ghost occurred in a halftone image was confirmed in order to confirm whether or not toner was condensed in the developing apparatus 20E. The result of Experiment 7 is indicated in Table 7.

TABLE 7

| | (1) | (2) | (3) | (4) | (5) |
|---|---|---|---|---|---|
| Minimum distance (mm) | 0.3 | 0.5 | 1 | 2 | 2.5 |
| Stripe fogging | Did not occur | Did not occur | Did not occur | Did not occur | Slightly occurred |

TABLE 7-continued

| | (1) | (2) | (3) | (4) | (5) |
|---|---|---|---|---|---|
| Amount of additionally supplied toner (g) | 0.6 | 0.8 | 1.2 | 1.5 | 2.2 |
| Ghost in image | Occurred | Did not occur | Did not occur | Did not occur | Did not occur |

As indicated in Table 7, when the minimum distance was excessively long (2.5 mm), an action and effect of the reduction paddle 29 was reduced and stripe fogging slightly occurred. On the other hand, when the minimum distance was excessively short (0.3 mm), toner was condensed between the conveying capability reduction wall 28H and the reduction paddle 29, and ghost occurred in the image. Therefore, the minimum distance between the reduction paddle 29 and the conveying capability reduction wall 28H according to rotation of the first agitating screw 23C is preferably longer than or equal to 0.5 mm, and preferably not longer than 2.0 mm.

The developing apparatuses 20, 20A, 20B, 20C, 20D, and 20E according to the embodiments of the present disclosure and the image forming apparatus 1 that includes the developing apparatus 20, 20A, 20B, 20C, 20D, or 20E are described above. However, the present disclosure is not limited to the embodiments described above, and, for example, modifications as described below may be implemented.

In the embodiments described above, additional supply of toner from the toner container 50 to the developing apparatus 20, 20A, 20B, 20C, 20D, or 20E is adjusted according to the accumulation portion 27, the accumulation portion 27A, the accumulation portion 27B, the accumulation portion 27C, or the accumulation portion 27D. However, the present disclosure is not limited thereto. Toner may be additionally supplied from the toner container 50 into the development housing 210 according to a detection result from a not-illustrated density sensor that detects an image density, or a not-illustrated toner sensor that detects an amount of toner in the development housing 210.

In the embodiments described above, magnetic toner is used as developer. However, the present disclosure is not limited thereto. Non-magnetic toner, or two-component developer may be used as developer.

Figure 21A:
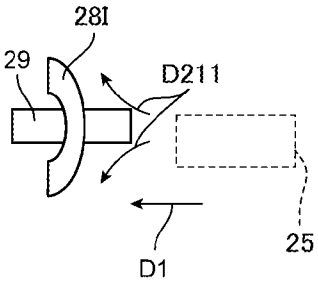
FIG. 21A, FIG. 21B, and FIG. 21C each illustrate a shape of a conveying capability reduction wall according to another embodiment.
Figure 21B:
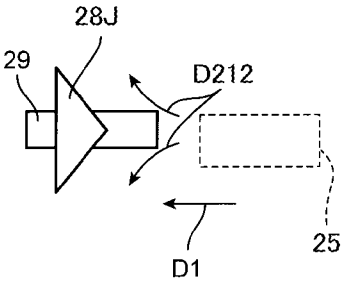
Figure 21C:
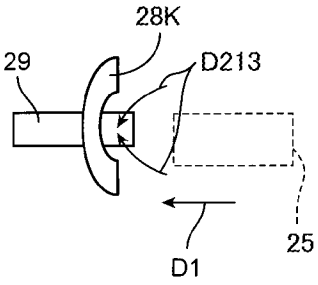

In the embodiment described above, the conveying capability reduction wall 28H that is used in combination with the reduction paddle 29 is formed as a flat-plate-like member (FIG. 18). However, the present disclosure is not limited thereto. FIGS. 21A, 21B, and 21C are partial plan views schematically illustrating shapes of a conveying capability reduction wall 28I, a conveying capability reduction wall 28J, and a conveying capability reduction wall 28K according to various modifications, respectively. The conveying capability reduction wall 28I shown in FIG. 21A has such a curved shape that the center portion projects toward the upstream side, in the conveying direction (the first direction, the direction indicated by an arrow D1), of the first agitating screw 23. In this case, the additional toner supplied through the toner supply inlet 25 is conveyed in a direction orthogonal to the first direction so as to be separated as indicated by arrows D211. Therefore, dispersion of the additionally supplied toner is performed with an enhanced effectiveness. Similarly, the conveying capability reduction wall 28J shown in FIG. 21B has such a triangular cross-section that the center portion projects toward the upstream side, in the first direction, of the first agitating screw 23. In this case, the additional toner supplied through the toner supply inlet 25 is conveyed in a direction orthogonal to the first direction so as to be separated as indicated by arrows D212. Therefore, dispersion of the additionally supplied toner is performed with an enhanced effectiveness. On the other hand, the conveying capability reduction wall 28K shown in FIG. 21C has such a curved shape that the center portion projects toward the downstream side, in the first direction, of the first agitating screw 23. In this case, the additional toner supplied through the toner supply inlet 25 is conveyed in a direction orthogonal to the first direction so as to merge as indicated by arrows D213. Therefore, hitting in the additionally supplied toner occurs, and thereafter the toner is dispersed therearound, whereby the additionally supplied toner and toner therearound are mixed with each other with an enhanced effectiveness.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A developing apparatus comprising:

a housing that has a pair of wall portions, and a top cover which extends between the pair of wall portions;

an additional-developer storage portion that is detachably mounted to the housing and stores additional developer to be supplied into the housing;

a developing roller that is rotatably supported, by the housing, between the pair of wall portions, and that carries developer;

a developer conveying path that includes a first conveying path which is disposed in the housing so as to be spaced from the developing roller, and in which the developer is conveyed in a first direction, and a second conveying path which is disposed between the developing roller and the first conveying path, in which the developer is conveyed in a second direction opposite to the first direction, and by which the developer is supplied to the developing roller, the developer conveying path having an upper portion defined by the top cover;

a divider that is disposed in the housing and that divides the first conveying path and the second conveying path from each other;

a first communication path disposed between one of the paired wall portions and a corresponding one of end portions of the divider, and a second communication path disposed between the other of the paired wall portions and the other of the end portions of the divider, the first communication path having a function of delivering the developer from the first conveying path to the second conveying path, the second communication path having a function of delivering the developer from the second conveying path to the first conveying path;

a developer reception opening that is formed in the housing so as to oppose a position on a downstream side, in the first direction, of the first conveying path, and that allows the additional developer to be received therethrough and supplied into the developer conveying path;

a conveying member that is disposed in the first conveying path, is driven to rotate, and conveys the developer in the first direction such that the developer passes by a position where the developer reception opening opposes the first conveying path;

a downstream-side conveying capability reduction portion that is disposed, in the conveying member or the housing, downstream of the developer reception opening in the first direction, and that locally reduces a developer conveying capability, for the developer, of the conveying member, to form a first accumulation portion in which the developer is accumulated at a position opposing the developer reception opening; and an upstream-side conveying capability reduction wall that is disposed upstream of the developer reception opening in the first direction so as to project from the top cover toward the conveying member, and that locally reduces a developer conveying capability, for the developer, of the conveying member, to form a second accumulation portion in which the developer is accumulated upstream of the developer reception opening in the first direction.

2. The developing apparatus according to claim 1, wherein the downstream-side conveying capability reduction portion is a downstream-side conveying capability reduction wall disposed downstream of the developer reception opening in the first direction so as to project from the top cover toward the conveying member.

3. The developing apparatus according to claim 2, wherein, when H1 represents a height by which the downstream-side conveying capability reduction wall projects from the top cover, and H2 represents a height by which the upstream-side conveying capability reduction wall projects from the top cover, a relationship of $H2 \leq H1 \leq 2 \times H2$ is satisfied.

4. The developing apparatus according to claim 2, wherein the conveying member includes: a rotation shaft; screw blades formed around the rotation shaft; and elimination portions, disposed in regions that oppose the downstream-side conveying capability reduction wall and the upstream-side conveying capability reduction wall, in which the screw blades are locally eliminated, and the downstream-side conveying capability reduction wall and the upstream-side conveying capability reduction wall are disposed such that an end of each of the downstream-side conveying capability reduction wall and the upstream-side conveying capability reduction wall is closer to the rotation shaft than outer circumferential edges of the screw blades are.

5. The developing apparatus according to claim 3, wherein the conveying member includes: a rotation shaft; screw blades formed around the rotation shaft; and elimination portions, disposed in regions that oppose the downstream-side conveying capability reduction wall and the upstream-side conveying capability reduction wall, in which the screw blades are locally eliminated, and the downstream-side conveying capability reduction wall and the upstream-side conveying capability reduction wall are disposed such that an end of each of the downstream-side conveying capability reduction wall and the upstream-side conveying capability reduction wall is closer to the rotation shaft than outer circumferential edges of the screw blades are.

6. The developing apparatus according to claim 1, wherein the conveying member includes a rotation shaft, and screw blades formed around the rotation shaft, and the downstream-side conveying capability reduction portion is a paddle member disposed between the screw blades adjacent to each other.

7. A developing apparatus comprising:

a housing that has a pair of wall portions, and a top cover which extends between the pair of wall portions;

an additional-developer storage portion that is detachably mounted to the housing and stores additional developer to be supplied into the housing;

a developing roller that is rotatably supported, by the housing, between the pair of wall portions, and that carries developer;

a developer conveying path that includes a first conveying path which is disposed in the housing so as to be spaced from the developing roller, and in which the developer is conveyed in a first direction, and a second conveying path which is disposed between the developing roller and the first conveying path, in which the developer is conveyed in a second direction opposite to the first direction, and by which the developer is supplied to the developing roller, the developer conveying path having an upper portion defined by the top cover, and allowing the developer to be circulated and conveyed therein;

a developer reception opening that is formed in the housing so as to oppose a position on a downstream side, in the first direction, of the first conveying path, and that allows the additional developer to be received therethrough and supplied into the developer conveying path;

a conveying member that is disposed in the first conveying path, is driven to rotate, and conveys the developer in the first direction such that the developer passes by a position where the developer reception opening opposes the first conveying path; and a conveying capability reduction wall that is disposed downstream of the developer reception opening in the first direction so as to project from the top cover toward the conveying member, and that locally reduces a developer conveying capability, for the developer, of the conveying member, to form an accumulation portion in which the developer is accumulated at a position opposing the developer reception opening.

8. The developing apparatus according to claim 7, wherein the conveying member includes: a rotation shaft; screw blades formed around the rotation shaft; and an elimination portion, disposed in a region that opposes the conveying capability reduction wall, in which the screw blades are locally eliminated, and the conveying capability reduction wall has a lower end that is closer to the rotation shaft than outer circumferential edges of the screw blades are.

9. The developing apparatus according to claim 8, wherein the conveying capability reduction wall is a plate-like member that extends in a direction orthogonal to the rotation shaft, the developing apparatus further comprising an agitating paddle that projects from the rotation shaft in a radial direction so as to oppose the conveying capability reduction wall, and passes below the conveying capability reduction wall according to rotation of the conveying member.

10. The developing apparatus according to claim 9, wherein an end portion, on an upstream side in the first direction, of the agitating paddle, is positioned downstream of the developer reception opening in the first direction, and upstream of the conveying capability reduction wall in the first direction, and an end portion, on a downstream side in the first direction, of the agitating paddle, is positioned downstream of the conveying capability reduction wall in the first direction.

11. The developing apparatus according to claim 9, wherein a minimum distance between the agitating paddle and the conveying capability reduction wall according to rotation of the conveying member is longer than or equal to 0.5 mm, and not longer than 2.0 mm.

12. The developing apparatus according to claim 10, wherein a minimum distance between the agitating paddle and the conveying capability reduction wall according to rotation of the conveying member is longer than or equal to 0.5 mm, and not longer than 2.0 mm.

13. The developing apparatus according to claim 8, wherein the conveying capability reduction wall is a plate-like member that extends in a direction orthogonal to the rotation shaft, and the lower end of the conveying capability reduction wall horizontally extends, and is positioned so as to be lower than upper ends of the screw blades that rotate, by a distance that is longer than or equal to 1.5 mm, and not longer than 2.0 mm.

14. The developing apparatus according to claim 8, wherein, in a case where a cross-section orthogonal to the rotation shaft is viewed, the conveying capability reduction wall has such an arched shape as to surround the conveying member, and in a case where H1 represents a height by which a center portion of the conveying capability reduction wall projects from the top cover, and H2 represents a height by which both end portions of the conveying capability reduction wall each project from the top cover, a relationship of $H1<H2$ is satisfied.

15. The developing apparatus according to claim 7, wherein the number of the conveying capability reduction walls is plural, and the plural conveying capability reduction walls are spaced from each other in the first direction.

16. The developing apparatus according to claim 15, wherein, the plural conveying capability reduction walls include a first reduction wall that is disposed on a downstream side in the first direction, and a second reduction wall that is disposed on an upstream side in the first direction, and in a case where H3 represents a height by which the first reduction wall projects from the top cover, and H4 represents a height by which the second reduction wall projects from the top cover, a relationship of $H3>H4$ is satisfied.

17. An image forming apparatus comprising:

a developing apparatus;

an image carrier which has a surface on which an electrostatic latent image is formed, and to which developer is supplied from the developing apparatus, and a transfer device that transfers an image from the image carrier to a sheet, wherein the developing apparatus includes:

a housing that has a pair of wall portions, and a top cover which extends between the pair of wall portions;

an additional-developer storage portion that is detachably mounted to the housing and stores additional developer to be supplied into the housing;

a developing roller that is rotatably supported, by the housing, between the pair of wall portions, and that carries developer;

a developer conveying path that includes a first conveying path which is disposed in the housing so as to be spaced from the developing roller, and in which the developer is conveyed in a first direction, and a second conveying path which is disposed between the developing roller and the first conveying path, in which the developer is conveyed in a second direction opposite to the first direction, and by which the developer is supplied to the developing roller, the developer conveying path having an upper portion defined by the top cover;

a divider that is disposed in the housing and that divides the first conveying path and the second conveying path from each other;

a first communication path disposed between one of the paired wall portions and a corresponding one of end portions of the divider, and a second communication path disposed between the other of the paired wall portions and the other of the end portions of the divider, the first communication path having a function of delivering the developer from the first conveying path to the second conveying path, the second communication path having a function of delivering the developer from the second conveying path to the first conveying path;

a developer reception opening that is formed in the housing so as to oppose a position on a downstream side, in the first direction, of the first conveying path, and that allows the additional developer to be received therethrough and supplied into the developer conveying path;

a conveying member that is disposed in the first conveying path, is driven to rotate, and conveys the developer in the first direction such that the developer passes by a position where the developer reception opening opposes the first conveying path;

a downstream-side conveying capability reduction portion that is disposed, in the conveying member or the housing, downstream of the developer reception opening in the first direction, and that locally reduces a developer conveying capability, for the developer, of the conveying member, to form a first accumulation portion in which the developer is accumulated at a position opposing the developer reception opening; and an upstream-side conveying capability reduction wall that is disposed upstream of the developer reception opening in the first direction so as to project from the top cover toward the conveying member, and that locally reduces a developer conveying capability, for the developer, of the conveying member, to form a second accumulation portion in which the developer is accumulated upstream of the developer reception opening in the first direction.

18. An image forming apparatus comprising:

a developing apparatus;

an image carrier which has a surface on which an electrostatic latent image is formed, and to which developer is supplied from the developing apparatus, and a transfer device that transfers an image from the image carrier to a sheet, wherein the developing apparatus includes:

a housing that has a pair of wall portions, and a top cover which extends between the pair of wall portions;

an additional-developer storage portion that is detachably mounted to the housing and stores additional developer to be supplied into the housing;

a developing roller that is rotatably supported, by the housing, between the pair of wall portions, and that carries developer;

a developer conveying path that includes a first conveying path which is disposed in the housing so as to be spaced from the developing roller, and in which the developer is conveyed in a first direction, and a second conveying path which is disposed between the developing roller and the first conveying path, in which the developer is conveyed in a second direction opposite to the first direction, and by which the developer is supplied to the developing roller, the developer conveying path having an upper portion defined by the top cover, and allowing the developer to be circulated and conveyed therein;

a developer reception opening that is formed in the housing so as to oppose a position on a downstream side, in the first direction, of the first conveying path, and that allows the additional developer to be received therethrough and supplied into the developer conveying path;

a conveying member that is disposed in the first conveying path, is driven to rotate, and conveys the developer in the first direction such that the developer passes by a position where the developer reception opening opposes the first conveying path; and a conveying capability reduction wall that is disposed downstream of the developer reception opening in the first direction so as to project from the top cover toward the conveying member, and that locally reduces a developer conveying capability, for the developer, of the conveying member, to form an accumulation portion in which the developer is accumulated at a position opposing the developer reception opening.

* * * * *